US007656369B2

(12) United States Patent
Chung et al.

(10) Patent No.: US 7,656,369 B2
(45) Date of Patent: Feb. 2, 2010

(54) APPARATUS AND METHOD FOR DRIVING ORGANIC LIGHT-EMITTING DIODE

(75) Inventors: Hoon Ju Chung, Gyeonggi-do (KR); Jae Ho Sim, Daegu (KR); Jung Chul Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 634 days.

(21) Appl. No.: 11/156,594

(22) Filed: Jun. 21, 2005

(65) Prior Publication Data

US 2006/0103322 A1 May 18, 2006

(30) Foreign Application Priority Data

Nov. 17, 2004 (KR) ..... 10-2004-94218

(51) Int. Cl.
*G09G 3/36* (2006.01)

(52) U.S. Cl. ..... 345/80; 345/76; 345/204; 345/82; 345/36; 315/169.3

(58) Field of Classification Search ..... 345/92, 345/72, 76, 204; 315/169.3
See application file for complete search history.

(56) References Cited

U.S. PATENT DOCUMENTS 6,229,506 B1 * 5/2001 Dawson et al. ..... 345/82
6,229,508 B1 * 5/2001 Kane ..... 345/82
6,919,871 B2 * 7/2005 Kwon ..... 345/92
6,937,215 B2 * 8/2005 Lo ..... 345/82
6,949,884 B2 * 9/2005 Shih et al. ..... 315/169.3
7,057,588 B2 * 6/2006 Asano et al. ..... 345/76
7,075,238 B2 * 7/2006 Lee et al. ..... 315/169.1
7,109,952 B2 * 9/2006 Kwon ..... 345/76
7,277,071 B2 * 10/2007 Oh ..... 345/76
7,365,742 B2 * 4/2008 Kim et al. ..... 345/204
7,408,533 B2 * 8/2008 Eom et al. ..... 345/76
7,411,571 B2 * 8/2008 Huh ..... 345/80
7,414,600 B2 * 8/2008 Nathan et al. ..... 345/82
7,573,441 B2 * 8/2009 Kwon ..... 345/76
2004/0041750 A1 * 3/2004 Abe ..... 345/76
2004/0070557 A1 4/2004 Asano et al.
2004/0095168 A1 * 5/2004 Miyazawa ..... 327/108
2004/0095298 A1 * 5/2004 Miyazawa ..... 345/76
2004/0095338 A1 * 5/2004 Miyazawa ..... 345/204
2005/0017934 A1 * 1/2005 Chung et al. ..... 345/82

* cited by examiner

*Primary Examiner*—Sumati Lefkowitz
*Assistant Examiner*—Grant D Sitta
(74) *Attorney, Agent, or Firm*—McKenna Long & Aldridge

(57) ABSTRACT

A driving apparatus for an organic light-emitting diode includes an organic light-emitting diode, a driving switch that drives the organic light-emitting diode in response to a control voltage applied to a gate terminal of the driving switch, a high-level voltage source that supplies a high-level voltage to the driving switch, a data driving circuit that supplies a data voltage to a data line of the driving apparatus, a reference voltage source that supplies a reference voltage to the driving apparatus, and a capacitor that applies the control voltage to the gate terminal of the driving switch, the control voltage being a difference between the data voltage and the reference voltage.

2 Claims, 27 Drawing Sheets

APPARATUS AND METHOD FOR DRIVING ORGANIC LIGHT-EMITTING DIODE

This application claims the benefit of Korean Patent Application No. P2004-94218 filed in Korea on Nov. 17, 2004, which is hereby incorporated by reference.

BACKGROUND OF THE INVENTION

1. Field of the Invention

The present invention relates to an organic electro-luminescence display, and more particularly to an apparatus and a method for driving an organic light-emitting diode.

2. Description of the Related Art

Recently, various flat panel display devices have been developed, which are light, thin, and capable of resolving shortcomings of cathode ray tubes (CRT). Examples of these panel display devices include liquid crystal display (LCD), field emission display (FED), plasma display panel (PDP) and electro-luminescence (EL) display.

The EL display is a self-luminous device capable of light-emission by a re-combination of electrons with holes in a phosphorous material. EL displays are generally classified into inorganic EL display devices and organic EL display devices, depending on material and structure. An EL display provides similar advantages to the CRT. For example, the EL display has a faster response time than a passive-type light-emitting device, such as an LCD, which requires an additional light source.

FIG. 1 is a cross-sectional view of an organic EL structure for describing the operation of a light-emitting diode according to a related art. Referring to FIG. 1, the organic EL device of the EL display (ELD) includes an electron injection layer 4, an electron carrier layer 6, a light-emitting layer 8, a hole carrier layer 10, and a hole injection layer 12 that are sequentially disposed between a cathode 2 and an anode 14. The anode 14 can be a transparent electrode. The cathode 2 can be a metal electrode.

If a voltage is applied between the anode 14 and the cathode 2, electrons generated at the cathode 2 flow into the light-emitting layer 8, via the electron injection layer 4 and the electron carrier layer 6, while holes generated at the anode 14 flow into the light-emitting layer 8, via the hole injection layer 12 and the hole carrier layer 10. Thus, the electrons and the holes fed from the electron carrier layer 6 and the hole carrier layer 10, respectively, collide and recombine within the light-emitting layer 8 and generate light. Then, the light generated by the recombination of electrons in the light-emitting layer 8 is emitted out of the light-emitting diode, via the transparent electrode (i.e., the anode 14). Thus, a picture can be displayed using a plurality of such light-emitting diodes.

FIG. 2 is a schematic block diagram of an organic electro-luminescence display device according to the related art. Referring to FIG. 2, the related art organic EL display device includes an EL display panel 16 having a plurality of pixel cells PE forming a matrix. The pixel cells are located at pixel areas defined by crossings of scan electrode lines SL1 to SLn and data electrode lines DL1 to DLm. A scan driver 18 is provided for driving the scan electrode lines SL1 to SLn. A data driver 20 is provided for driving the data electrode lines DL1 to DLm. A timing controller 28 controls the timing for driving the gate driver 18 and the data driver 20.

FIG. 3 shows a cell driving circuit for driving a pixel cell in the organic electro-luminescence device according to the related art. Referring to FIG. 3, each pixel cell PE includes an organic light-emitting diode OLED and a light-emitting diode driving circuit 30. The organic light-emitting diode OLED is connected between a supply voltage line VDD and a ground GND. The light-emitting diode driving circuit 30 drives the light-emitting diode OLED in response to a driving signal supplied from each of the data electrode lines DL and the gate electrode lines SL.

More specifically, the light-emitting diode driving circuit 30 includes a driving thin film transistor (TFT) DT connected between the supply voltage line VDD and the light-emitting diode OELD, a switching TFT SW connected to the scan electrode lines SL, the data electrode lines DL and the driving TFT DT, and a storage capacitor Cst connected between a first node N1 positioned between the driving TFT DT and the switching TFT SW, and the supply voltage line VDD. Herein, the TFT is a p-type electron metal-oxide semiconductor field effect transistor (MOSFET).

A gate terminal of the driving TFT DT is connected to a drain terminal of the switching TFT SW. A source terminal of the driving TFT DT is connected to the supply voltage line VDD. A drain terminal of the driving TFT DT is connected to the light-emitting diode OLED.

A gate terminal of the switching TFT SW is connected to the scan electrode line SL. A source terminal of the switching TFT SW is connected to the data electrode line DL. A drain terminal of the switching TFT SW is connected to the gate terminal of the driving TFT DT.

The timing controller 28 generates a data control signal for controlling the data driver 20 and a scan control signal for controlling the scan driver 18. The timing controller 28 uses synchronizing signals supplied by an external system, for example a graphic card. Further, the timing controller 28 applies a data signal from the external system to the data driver 20.

The scan driver 18 generates a scanning pulse SP in response to the scanning control signal from the timing controller 28. The scan driver 18 applies the scanning pulse SP to the scan electrode lines SL1 to SLn to sequentially drive the scan electrode lines SL1 to SLn.

The data driver 20 supplies a data voltage to the data electrode lines DL1 to DLm every horizontal period H in response to the data control signal from the timing controller 28. The data driver 20 has output channels 21 that are in one-to-one correspondence with the data electrode lines DL1 to DLm.

In each pixel cell PE of the related art EL display device, if a scanning pulse SP having a LOW state is inputted from the scan driver 18 to the scan electrode line SL, then the switching TFT SW is turned on. When the switching TFT SW is turned on, a data voltage supplied from the data driver 20 to the data electrode line DL is applied, via the switching TFT SW, to the first node N1 in synchronization with the scanning pulse SP applied to the scan electrode line SL. The data voltage applied to the first node N1 is stored in the storage capacitor Cst.

The storage capacitor Cst stores the data voltage from the data electrode line DL during the time the scanning pulse SP is applied through the scan electrode line SL. The storage capacitor Cst holds the stored data voltage during one frame period. In other words, the storage capacitor Cst applies the stored data voltage to the driving TFT DT when the scanning pulse SP is not applied to the scan electrode line SL, to thereby turn on the driving TFT DT. Thus, the light-emitting diode OLED is turned on by a voltage difference between the supply voltage line VDD and the ground GND. The light-emitting diode emit light in proportion to the intensity of current flowing from the supply voltage line VDD through the driving TFT DT.

In the related art EL display device having such a structure, a device characteristic between the interior of the panel and the panel is non-uniformly formed due to instability in a laser output power during a polysilicon crystallization process. The output current of the driving TFT DT in response to the same data voltage changes because of the non-uniformity in the characteristics of the device. The pixel structure of the conventional EL display device fails to compensate for a non-uniformity in picture quality caused by the non-uniform characteristic of the driving TFT DT between the panel and its interior.

SUMMARY OF THE INVENTION

Accordingly, the present invention is directed to an apparatus and a method for driving an organic light-emitting diode that substantially obviate one or more problems due to limitations and disadvantages of the related art.

An object of the present invention to provide an apparatus for driving an organic light-emitting diode that compensates a non-uniformity in picture quality.

Another object of the present invention to provide a method for driving an organic light-emitting diode that compensates a non-uniformity in picture quality.

Additional features and advantages of the invention will be set forth in part in the description which follows, and in part will be apparent from the description, or may be learned by practice of the invention. The objectives and other advantages of the invention will be realized and attained by the structure particularly pointed out in the written description and claims hereof as well as the appended drawings.

To achieve these objects and other advantages and in accordance with the purpose of the present invention, as embodied and broadly described herein, a driving apparatus for an organic light-emitting diode includes an organic light-emitting diode, a driving switch that drives the organic light-emitting diode in response to a control voltage applied to a gate terminal of the driving switch, a high-level voltage source that supplies a high-level voltage to the driving switch, a data driving circuit that supplies a data voltage to a data line of the driving apparatus, a reference voltage source that supplies a reference voltage to the driving apparatus, and a capacitor that applies the control voltage to the gate terminal of the driving switch, the control voltage being a difference between the data voltage and the reference voltage.

In another aspect, a method of driving an organic light-emitting diode, including a driving switch for driving the organic light-emitting diode in response to a control voltage applied to a gate terminal of the driving switch, includes providing a data driving circuit for supplying a data voltage through a data line; providing a reference voltage source for supplying a reference voltage; providing a high-level voltage source to supply with a high-level voltage to the driving switch; applying a first voltage difference at the gate terminal of the driving switch, the first voltage difference being a difference between the high-level voltage and a threshold voltage of the driving switch; storing a second voltage difference into a capacitor, the second voltage difference being a difference between the data voltage and the reference voltage; and applying a third voltage difference to the gate terminal of the driving switch to turn-on the organic light-emitting diode, the third difference voltage being a difference between the first voltage difference and the second voltage difference.

In another aspect, a driving apparatus for an organic light-emitting diode, includes an organic light-emitting diode; a high-level voltage source that supplies a high-level voltage; a data driving circuit that supplies a data voltage; a reference voltage source that supplies a reference voltage to the driving apparatus; a driving switch that drives the organic light-emitting diode, the driving switching being connected between the high-level voltage source and the organic light-emitting diode; a capacitor connected by a first terminal thereof to a gate terminal of the driving switch; first switching means for turning on the driving switch during a first time period, while shorting a drain thereof to a ground; second switching means for applying a first voltage difference at the gate terminal of the driving switch during a second time period, the first voltage difference being a difference between the high-level voltage and a threshold voltage of the driving switch; and third switching means for applying a second voltage difference to a second terminal of the capacitor during a third time period, the second voltage difference being a difference between the data voltage and the reference voltage.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention.

DETAILED DESCRIPTION OF THE PREFERRED EMBODIMENTS

Reference will now be made in detail to the preferred embodiments of the present invention, examples of which are illustrated in the accompanying drawings.

Figure 1:
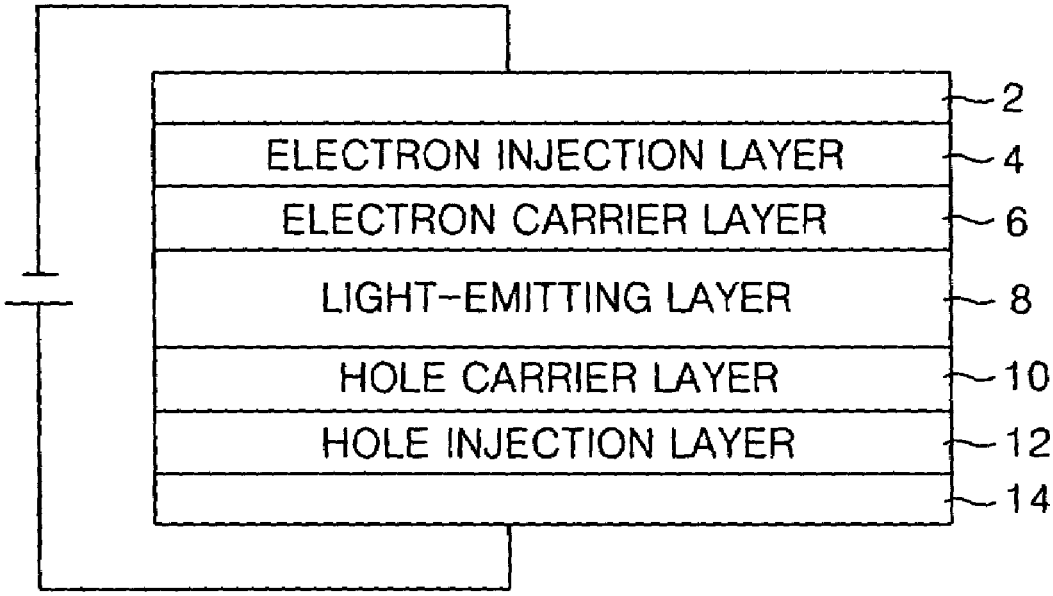
FIG. 1 RELATED ART
FIG. 1 is a cross-sectional view of an organic EL structure for describing the operation of a light-emitting diode, according to a related art.
Figure 2:
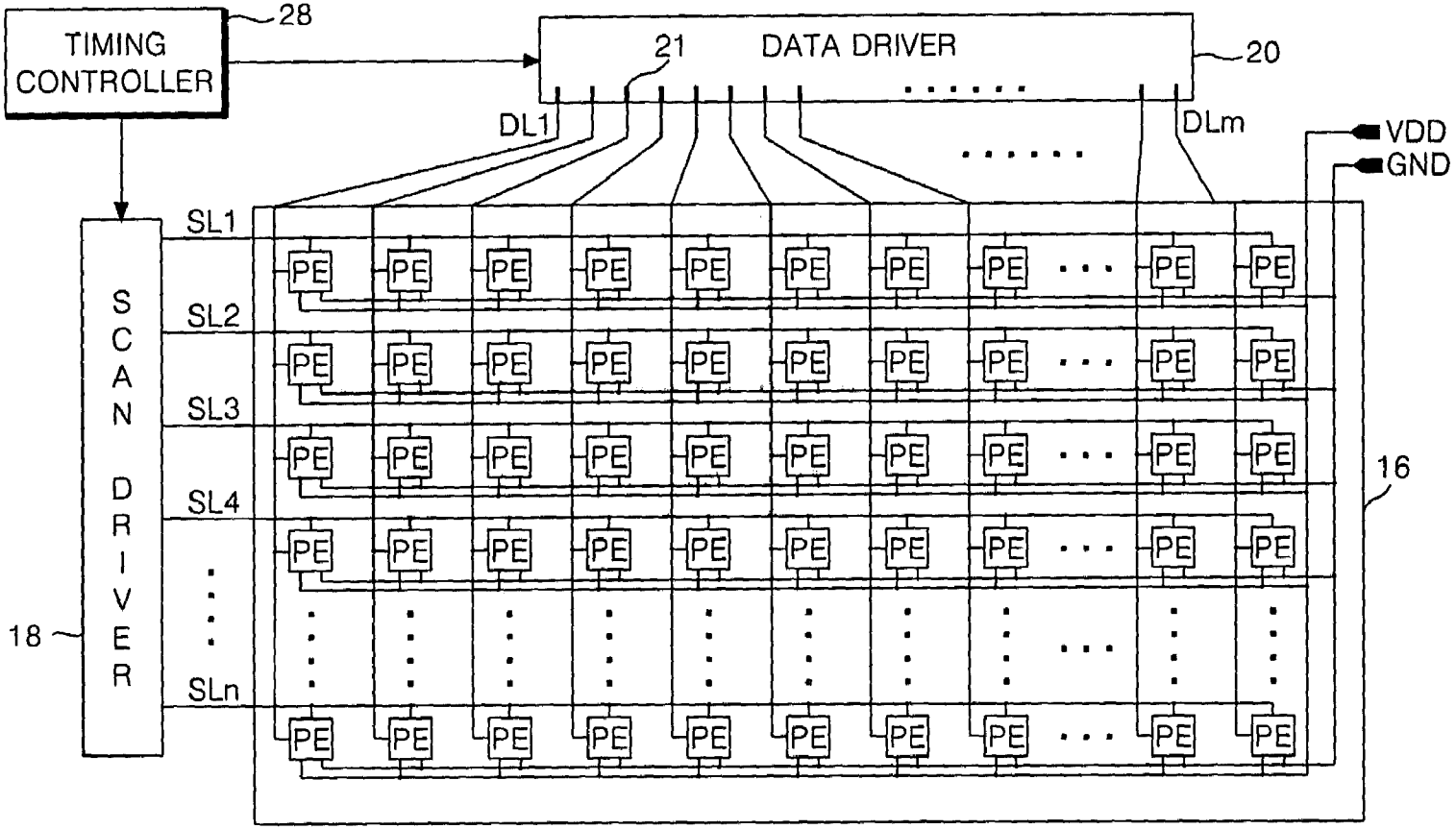
FIG. 2 RELATED ART
FIG. 2 is a schematic block diagram of an organic electro-luminescence display device, according to the related art.
Figure 3:
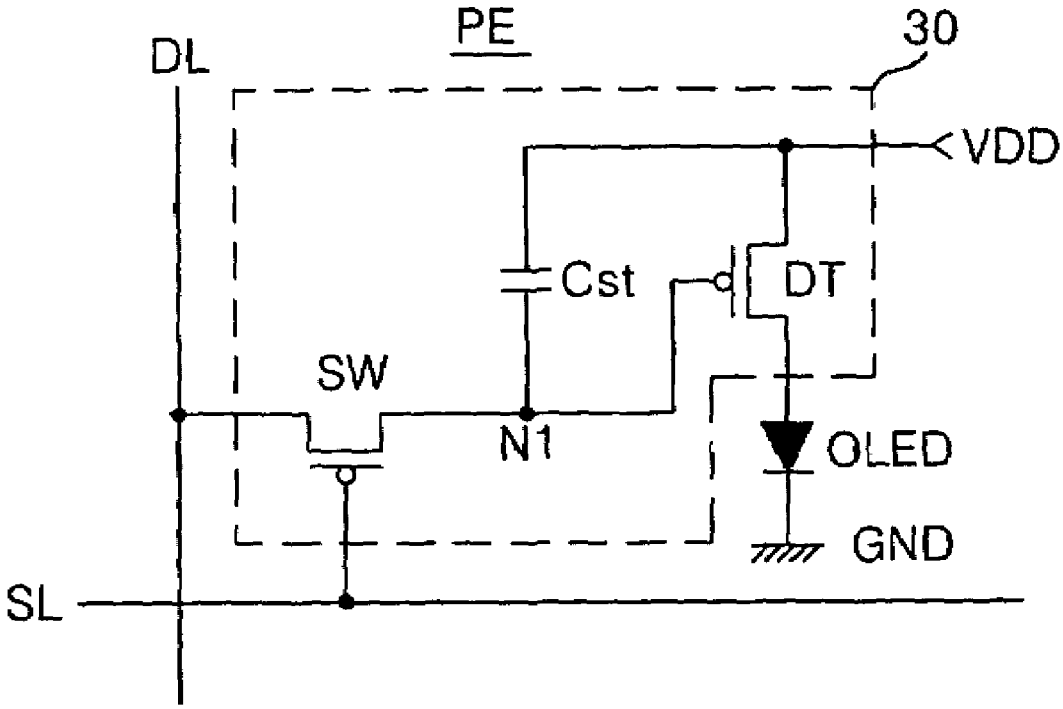
FIG.3 RELATED ART
FIG. 3 shows a cell driving circuit for driving a pixel cell in the organic electro-luminescence device, according to the related art.
Figure 4:
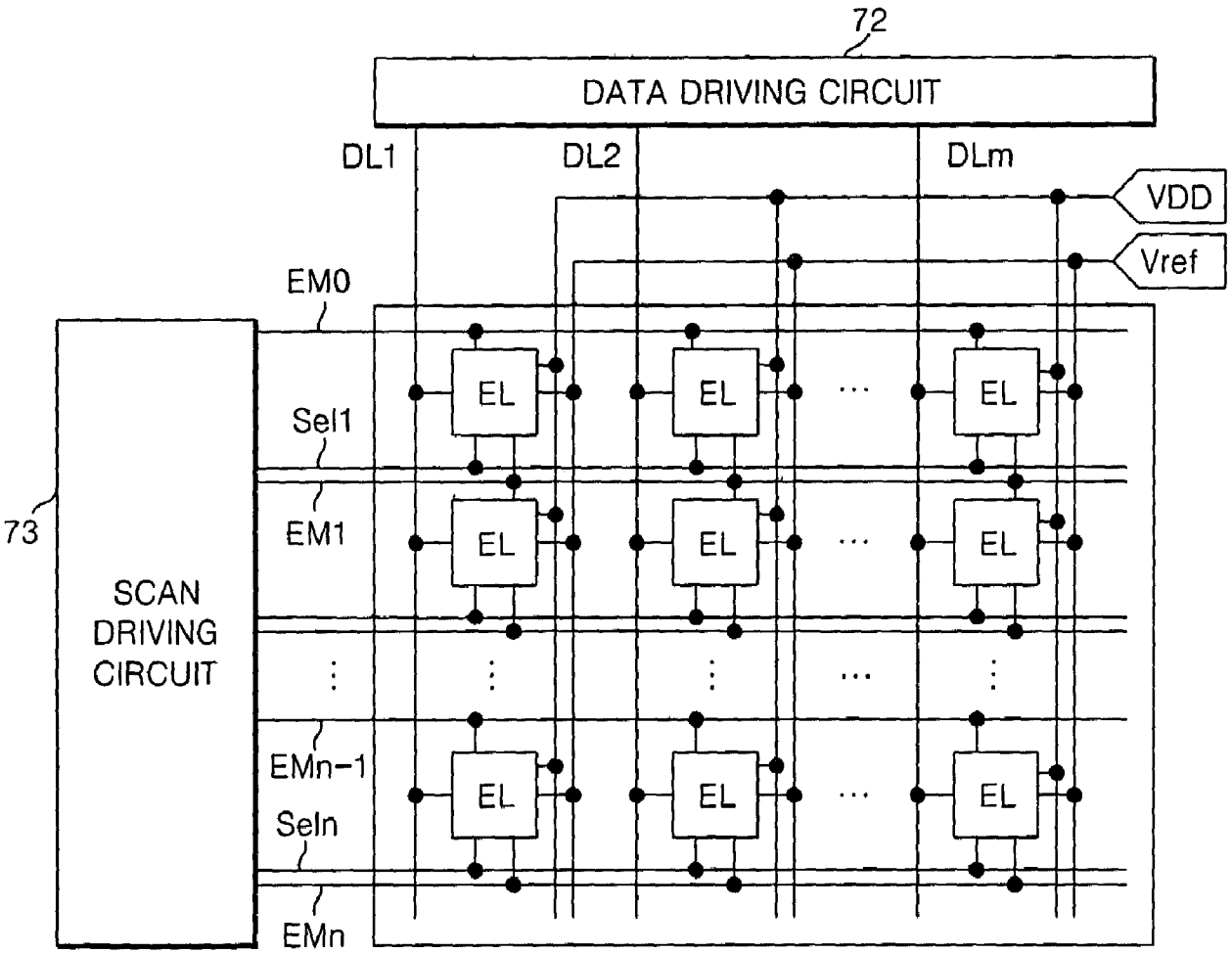
FIG. 4 is a schematic block circuit diagram of an exemplary driving apparatus of an organic electro-luminescence device, according to a first embodiment of the present invention.

FIG. 4 is a schematic block circuit diagram of an exemplary driving apparatus of an organic electro-luminescence (EL) device, according to a first embodiment of the present invention. Referring to FIG. 4, an organic EL device includes a plurality of pixel cells EL for displaying a picture. The pixel cells may form an array of an m-number of columns and an n-number of rows, where m and n are integers. A high-level voltage source VDD supplies a high-level voltage to the pixel cells. A reference voltage source Vref provides a reference voltage to the pixel cells. A data driving circuit 72 is connected to the pixel cells EL to supply data signals to the pixel cells EL. A scan driving circuit 73 supplies scan signals to the pixel cells EL. The scan driving circuit 73 provides a first selection signal SELn and a second selection signal EMn to the pixel cells on the n-numbered row through two scan lines. Also, a third selection signal EMn−1 is provided to the pixel cells EL on the n-numbered row. Herein, the third selection signal EMn−1 is a second selection signal at a pre-stage gate.

Figure 5:
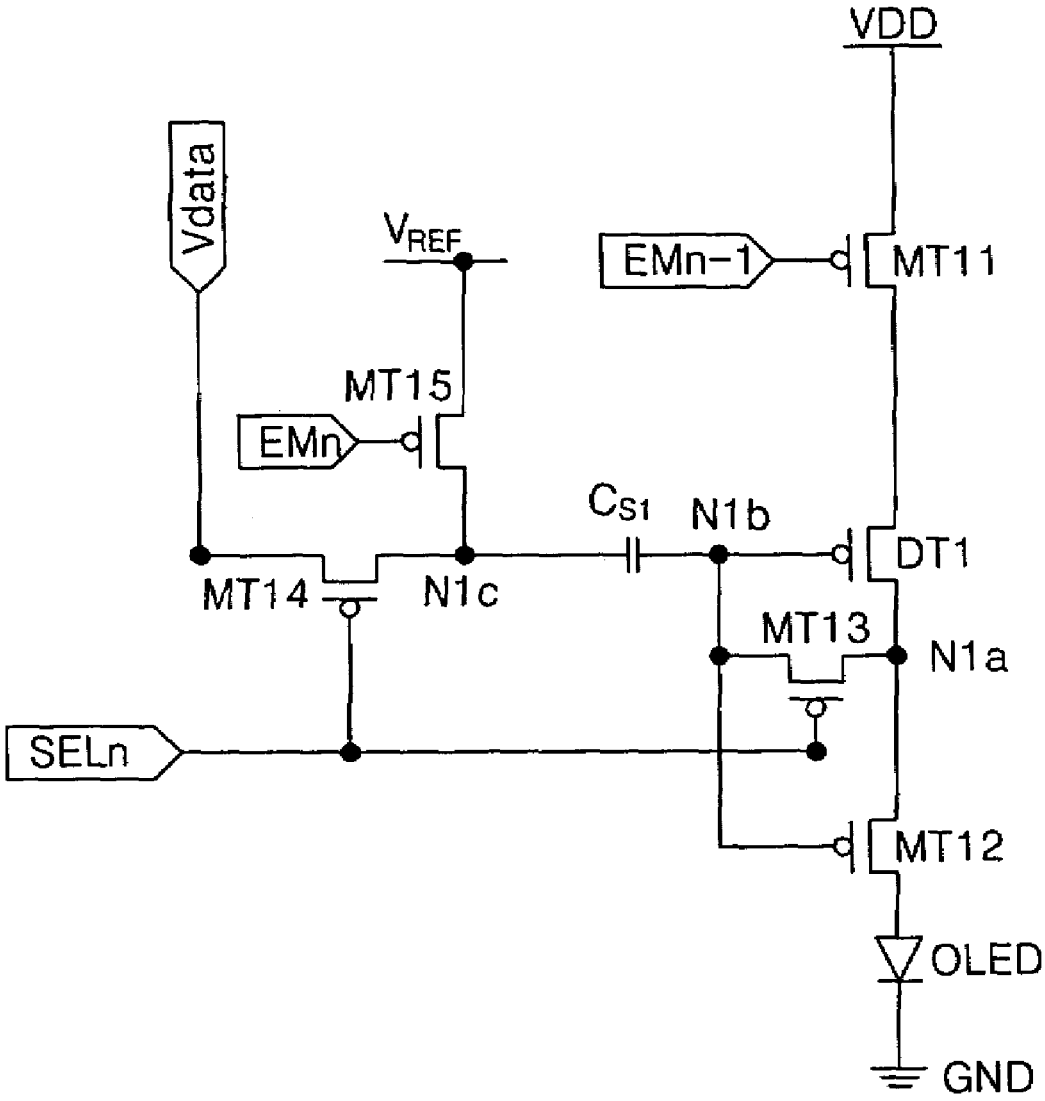
FIG. 5 shows an exemplary cell driving circuit for driving the pixel cells in the organic electro-luminescence device of FIG. 4.

FIG. 5 shows an exemplary cell driving circuit for driving the pixel cells in the organic electro-luminescence device of FIG. 4. Referring to FIG. 5, an exemplary pixel cell EL includes an organic light-emitting diode (OLED) connected between the high-level voltage source VDD and the ground voltage source GND. A driving switch DT1 of the pixel cell EL can be connected between switch MT12 and the light-emitting diode OLED at a first node N1*a*. A first switch MT11 can be connected between the high-level voltage source VDD and the driving switch DT1. A second switch MT12 can be connected between the driving switch DT1 and the light-emitting diode OLED. A third switch MT13 can be connected between a gate terminal and a drain terminal of the driving switch DT1. A fourth switch MT14 can be connected between a data voltage source Vdata and the gate terminal of the driving switch DT1. A capacitor Cs1 can be connected between a node N1*c* of the fourth switch MT14 and a node N1*b* at the gate terminal of the driving switch DT1. A fifth switch MT15 can be connected between the reference Vref and the connecting node N1*c*, between the fourth switch MT14 and the capacitor Cs1.

The first switch MT11 is supplied with the third selection signal EMn−1. The third switch MT13 and the fourth switch MT14 are supplied with the first selection signal SELn. The data voltage source Vdata provides the data signal to the fourth switch MT14. The fifth switch MT15 is supplied with the second selection signal EMn and the reference voltage Vref.

Figure 6:
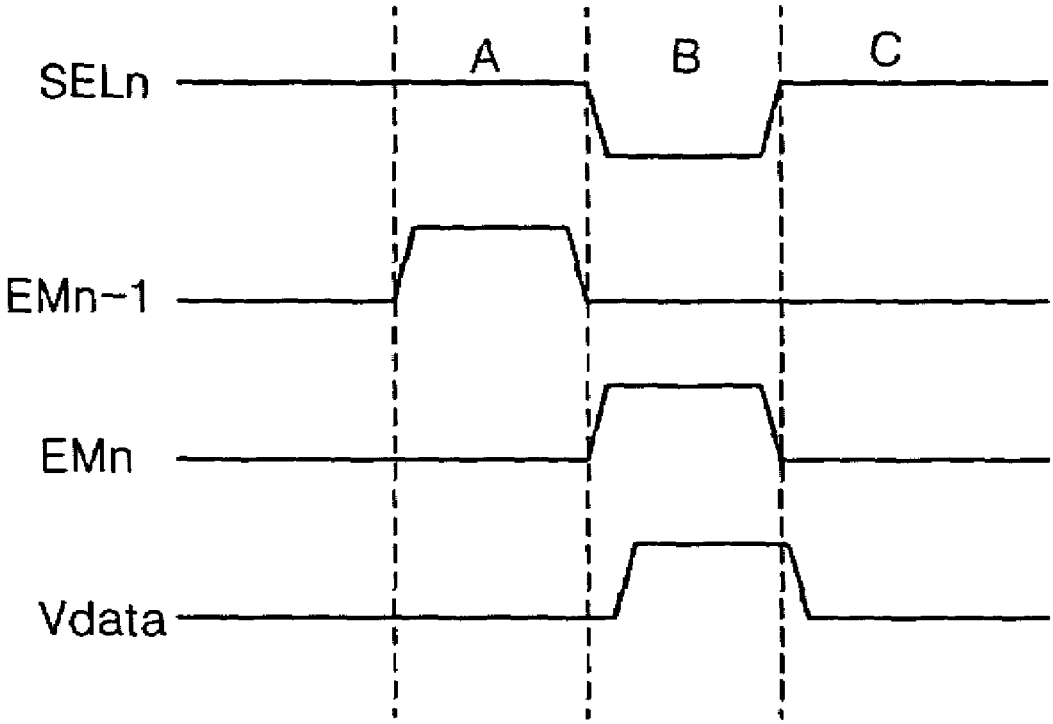
FIG. 6 is a driving waveform diagram for the cell driving circuit shown in FIG. 5.
Figure 7:
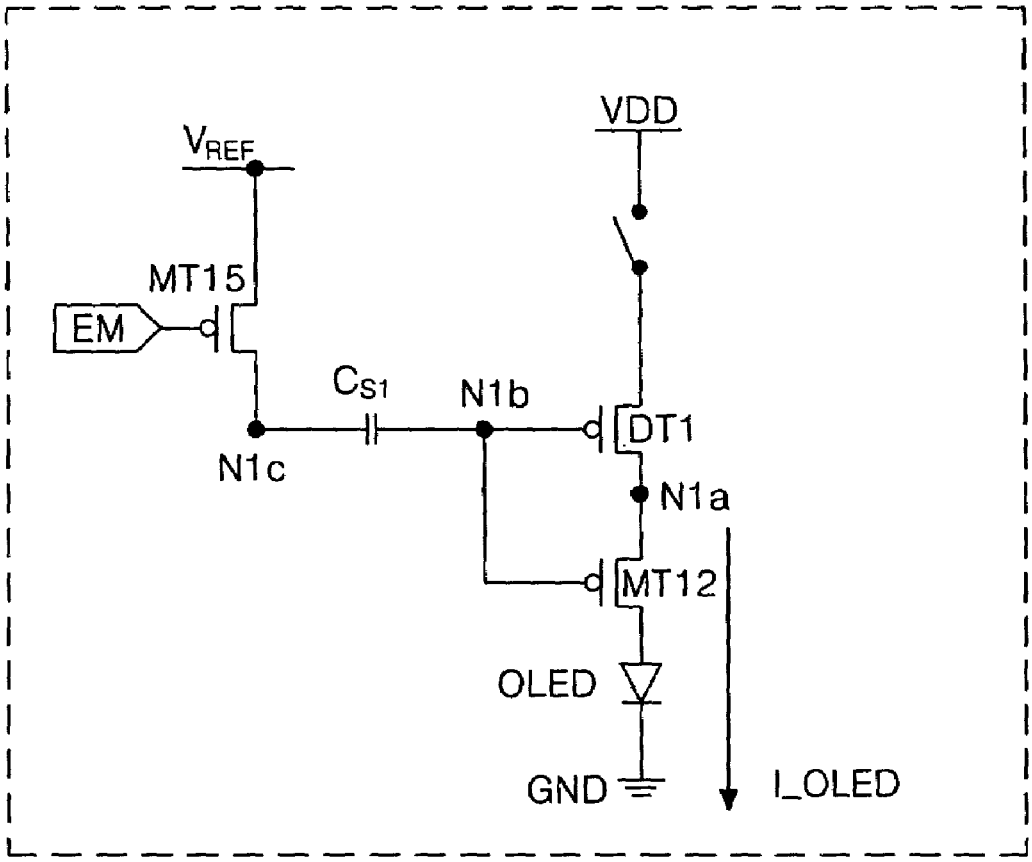
FIG. 7 shows an exemplary operation of the cell driving circuit during a first time period.

FIG. 6 is a driving waveform diagram for the cell driving circuit shown in FIG. 5. FIG. 7 shows an exemplary operation of the cell driving circuit during a first time period. Referring to FIG. 6, the first selection signal SELn and the second selection signal EMn are in opposite phase with respect to each other, and the third selection signal EMn−1 is in opposite phase and delayed by one horizontal period with respect to the first selection signal SELn. During a first time period A, the first selection signal SELn is high, the second selection signal EMn is low, and the third selection signal EMn−1 is high. The first switch MT11 is turned off by the high level third selection signal EMn−1. The driving switch DT1 and the second switch MT12 are turned on by the low level second selection signal EMn. Thus, during the first time period A, the driving switch DT1 and the second switch MT12 form a current path I_OLED through the light-emitting diode OLED. The first node N1*a* is shorted to ground GND by the current path I_OLED through the light-emitting diode OLED. Thus, the voltage at the first node N1*a* is driven sufficiently low.

Figure 8:
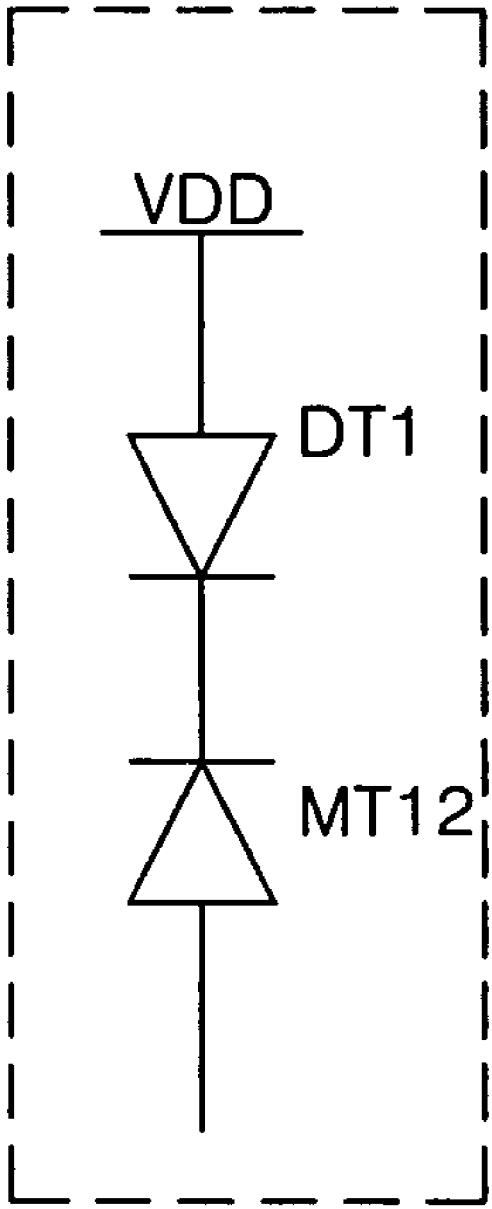
FIG. 8 shows an exemplary operation of the cell driving circuit during a second time period.

FIG. 8 shows an exemplary operation of the cell driving circuit during a second time period. During a second time period B, the first selection signal SELn is low, the second selection signal EMn is high, and the third selection signal EMn−1 is low. The first switch MT11 is turned on by the low level third selection signal EMn−1. The source terminal of the driving switch DT1 is charged by the high-level voltage source VDD. The third switch MT13 and the fourth switch MT14 are turned on by the first selection signal SELn. Thus, the driving switch DT1 and the second switch MT12 form a diode connection, thereby providing the equivalent circuit shown in FIG. 8. Accordingly, a voltage at the second node Nlb becomes the difference between the high-level voltage source VDD and a threshold voltage Vth of the driving switch DT1. Then, the data voltage Vdata is charged into the third node N1*c*.

Figure 9:
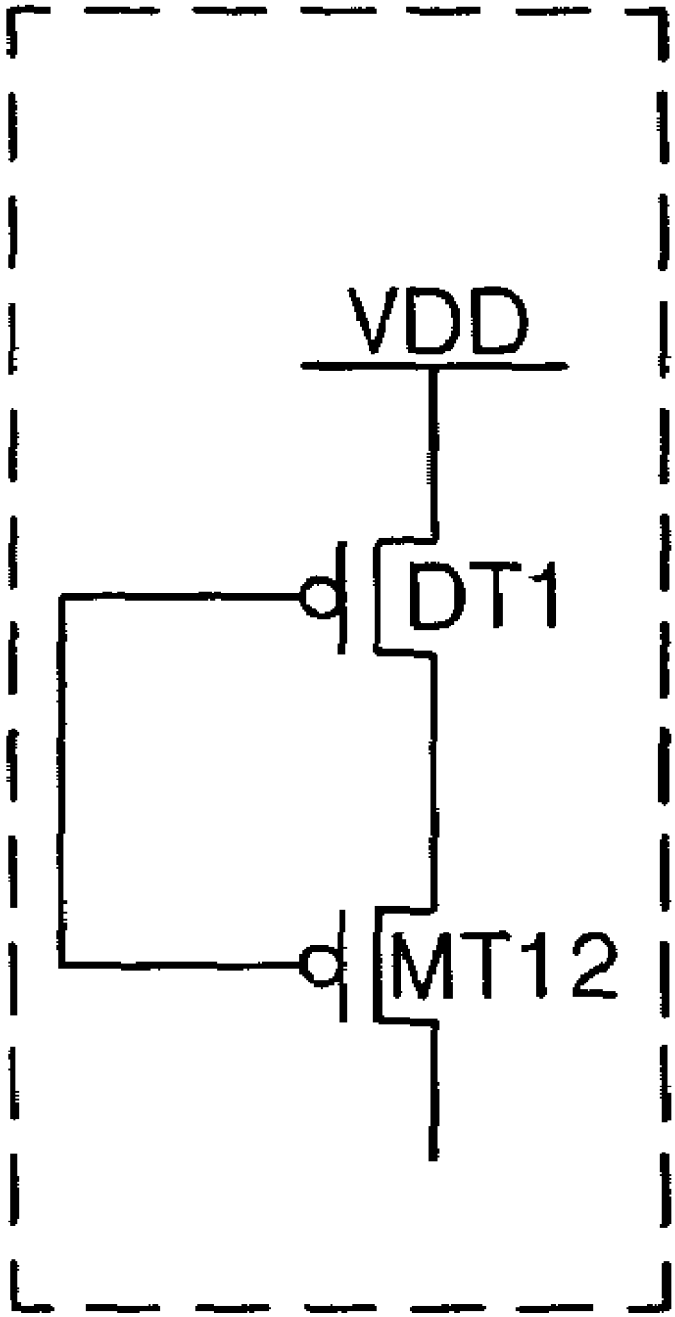
FIG. 9 shows an exemplary operation of the cell driving circuit during a third time period.

FIG. 9 shows an exemplary operation of the cell driving circuit during a third time period. During a third time period C, the first selection signal SELn is high, the second selection signal EMn is low, and the third selection signal EMn−1 is low. The fifth switch MT15 is turned on by the low level second selection signal EMn. As shown in FIG. 9, the gates of the driving switch DT1 and the second switch MT12 are shorted to each other. Herein, a voltage at the third node N1*c* becomes a difference between the data voltage Vdata and the reference voltage Vref. As a result, a voltage Vgs between the gate and the source of the driving switch DT1 satisfies the following equation:

$$Vgs=VDD-Vth-(V\text{data}-V\text{ref}) \quad \text{(Eq. 1)}$$

Here, VDD represents the high-level voltage source; Vdata represents the data voltage; Vth represents a threshold voltage of the driving switch DT1; and Vref represents a reference voltage. Moreover, Vref<Vdata.

Thus, a driving current I_OLED into the light-emitting diode OLED satisfies the following equation:

$$\text{I_OLED} = K\,(Vgs - Vth)2 \quad \text{(Eq. 2)}$$

$$\text{I_OLED} = K\,(VDD - VDD + Vth + V\text{data} - Vref - Vth)2$$

$$= K\,(V\text{data} - Vref)2$$

Here, VDD represents a voltage of the high-level voltage source; Vth represents the threshold voltage of the driving switch; Vref represents the level of the reference voltage source; and Vgs represents the voltage between the gate and the source of the driving switch.

According to the first embodiment of the present invention, a variation in the threshold voltage Vth of the driving switch or the high-level voltage source VDD does not cause a change in the driving current I_OLED through the light-emitting diode because the driving current I_OLED is determined by a difference between the data voltage Vdata and the reference voltage Vref. Thus, this embodiment of the present invention does not suffer from a stripe phenomenon caused by variations in threshold voltage Vth, which depends on a device characteristic of the driving switch, and a current/resistance drop phenomenon of the high-level voltage source VDD, which may be generated when driving a large screen display.

Figure 10:
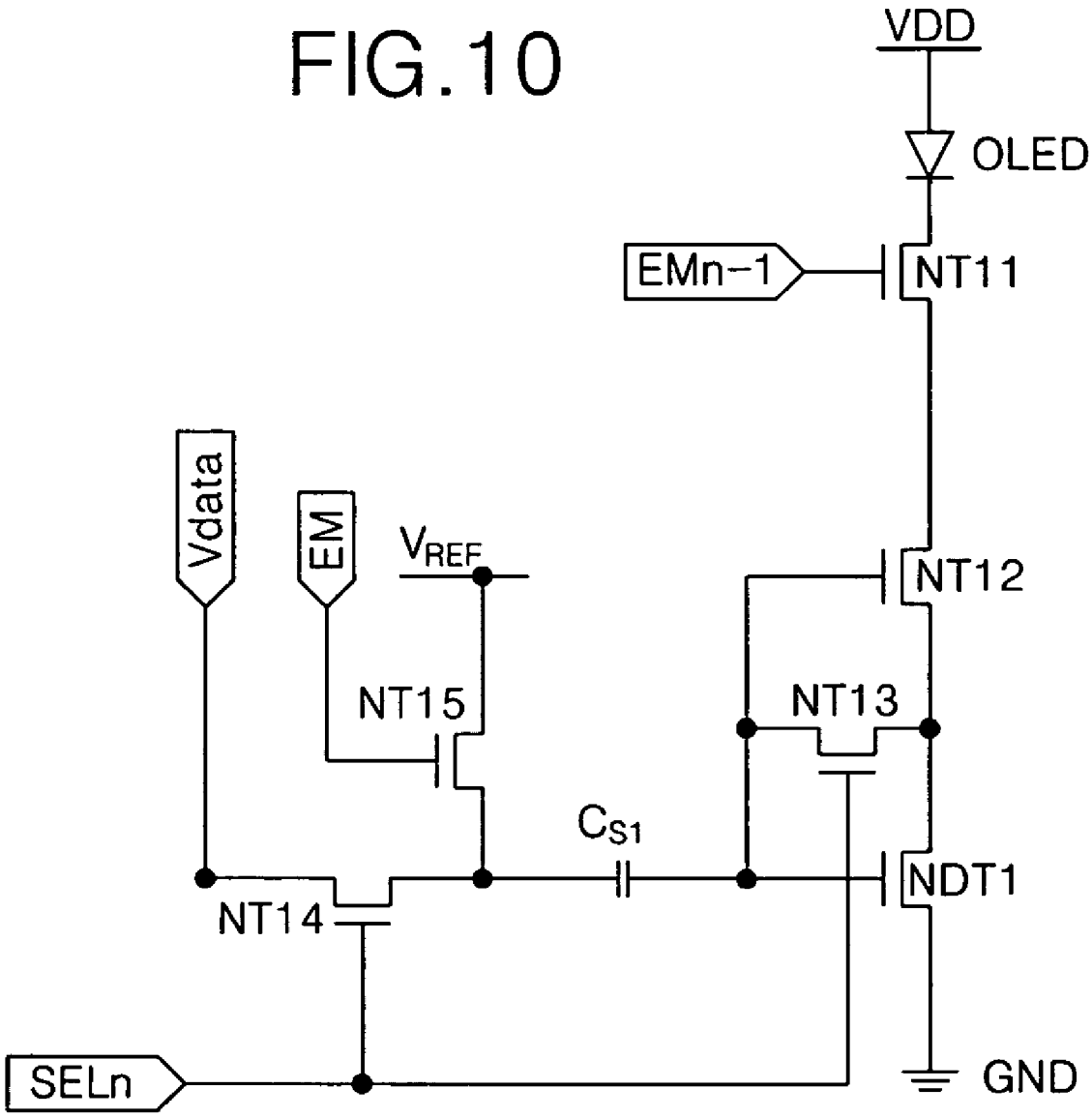
FIG. 10 shows another exemplary cell driving circuit using N-type switches for driving the pixel cells in the organic electro-luminescence device of FIG. 4.

FIG. 10 shows another exemplary cell driving circuit using N-type switches for driving the pixel cells in the organic electro-luminescence device of FIG. 4. As shown in FIG. 10, the driving switch NDT1 may be an N-type device. The first to fifth switches NT11 to NT15 may also be N-type devices.

Figure 11:
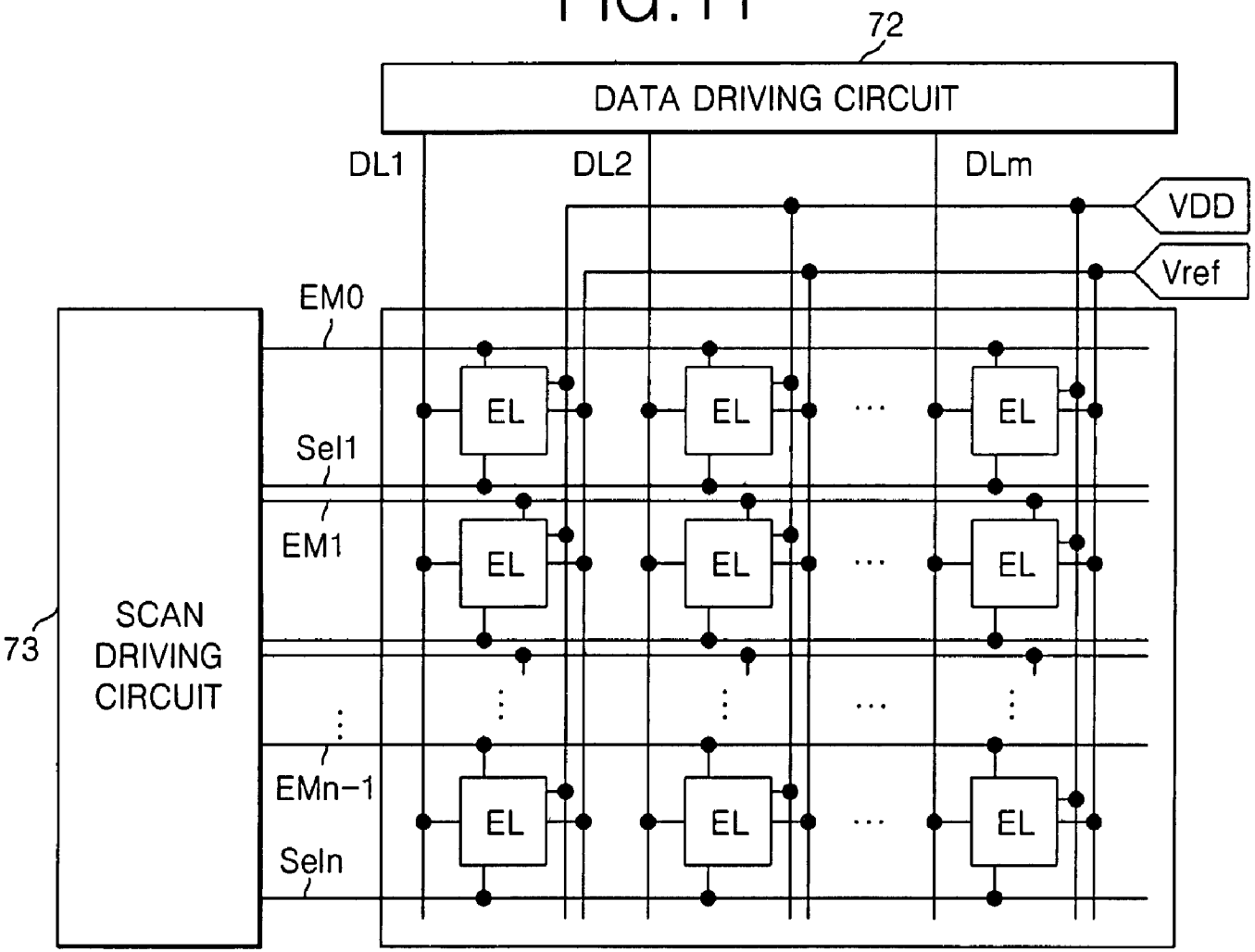
FIG. 11 is a schematic block circuit diagram of an exemplary driving apparatus of an organic electro-luminescence device, according to a second embodiment of the present invention.

FIG. 11 is a schematic block circuit diagram of an exemplary driving apparatus of an organic electro-luminescence device according to a second embodiment of the present invention. Referring to FIG. 11, an organic EL device includes a plurality of pixel cells EL for displaying a picture. The pixel cells may form an array of an m-number of columns and an n-number of rows. A high-level voltage source VDD supplies a high-level voltage to the pixel cells. A reference voltage source Vref provides a reference voltage to the pixel cells. A data driving circuit 72 is connected to the pixel cells EL to supply data signals to the pixel cells EL. A scan driving circuit 73 supplies scan signals to the pixel cells. The scan driving circuit 73 provides a first selection signal SELn and a second selection signal EMn−1 to the pixel cells on the n-numbered row through two scan lines.

Figure 12:
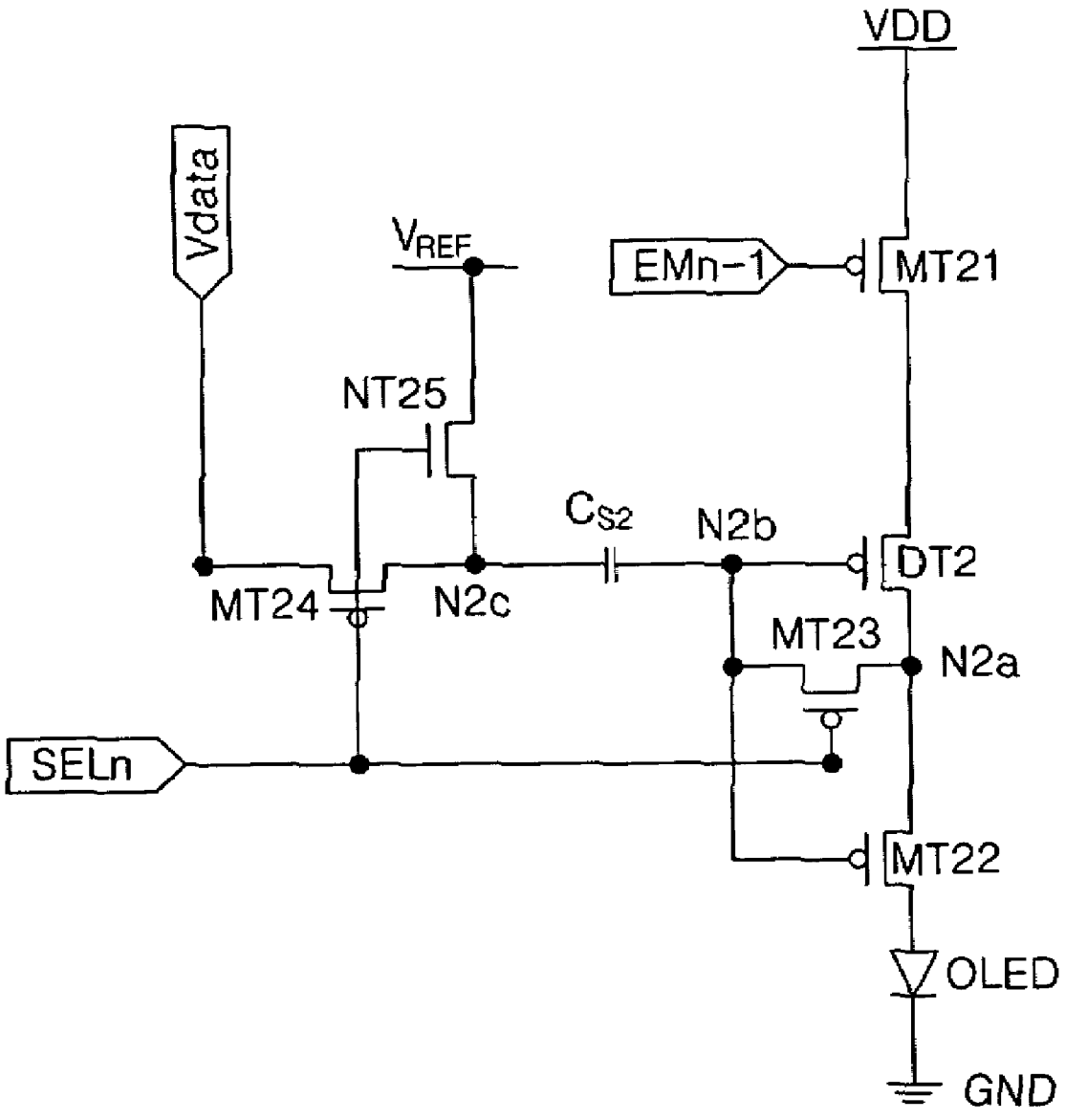
FIG. 12 shows an exemplary cell driving circuit for driving the pixel cells in the organic electro-luminescence device of FIG. 11.

FIG. 12 shows an exemplary cell driving circuit for driving the pixel cells in the organic electro-luminescence device of FIG. 11. Referring to FIG. 12, the cell driving circuit according to the second embodiment of the present invention has a structure similar to that of the cell driving circuit described above in reference to the first embodiment. Herein, a fifth switch NT25 is an N-type switch, which is driven by an applying the first selection signal SELn. Thus, further explanation of the cell driving circuit according to the second embodiment of the present invention will be omitted.

Figure 13:
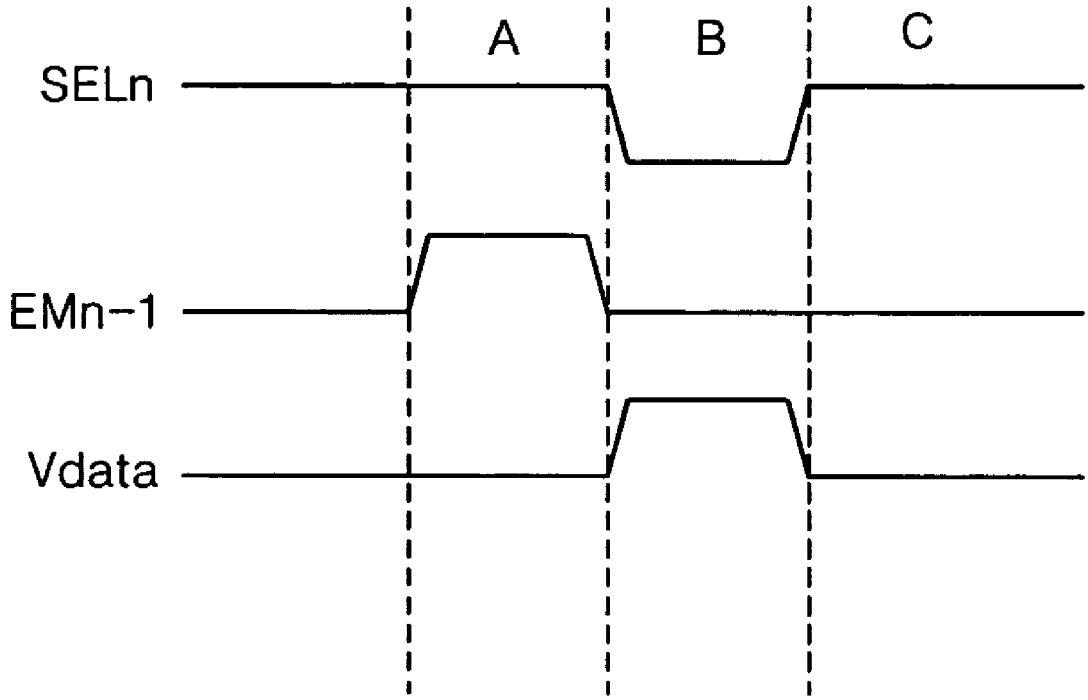
FIG. 13 is a driving waveform diagram for the cell driving circuit shown in FIG. 12.

FIG. 13 is a driving waveform diagram for the cell driving circuit shown in FIG. 12. Referring to FIG. 13, the driving waveform for the second embodiment of the present invention is similar to the driving waveform described above in reference to the first embodiment of the present invention. Here, the selection signal EMn is excluded and the fifth switch NT25 is driven with the first selection signal SELn. Thus, further explanation of the cell driving sequence according to the second embodiment of the present invention will be omitted.

According to the second embodiment of the present invention, the cell driving circuit having the above-described structure is made by a CMOS process. The cell driving circuit according to the second embodiment has the same driving current and a smaller number of selection signal lines in comparison to the cell driving circuit according to the first embodiment of the present invention. Thus, the aperture ratio can be improved and the circuitry simplified.

Figure 14:
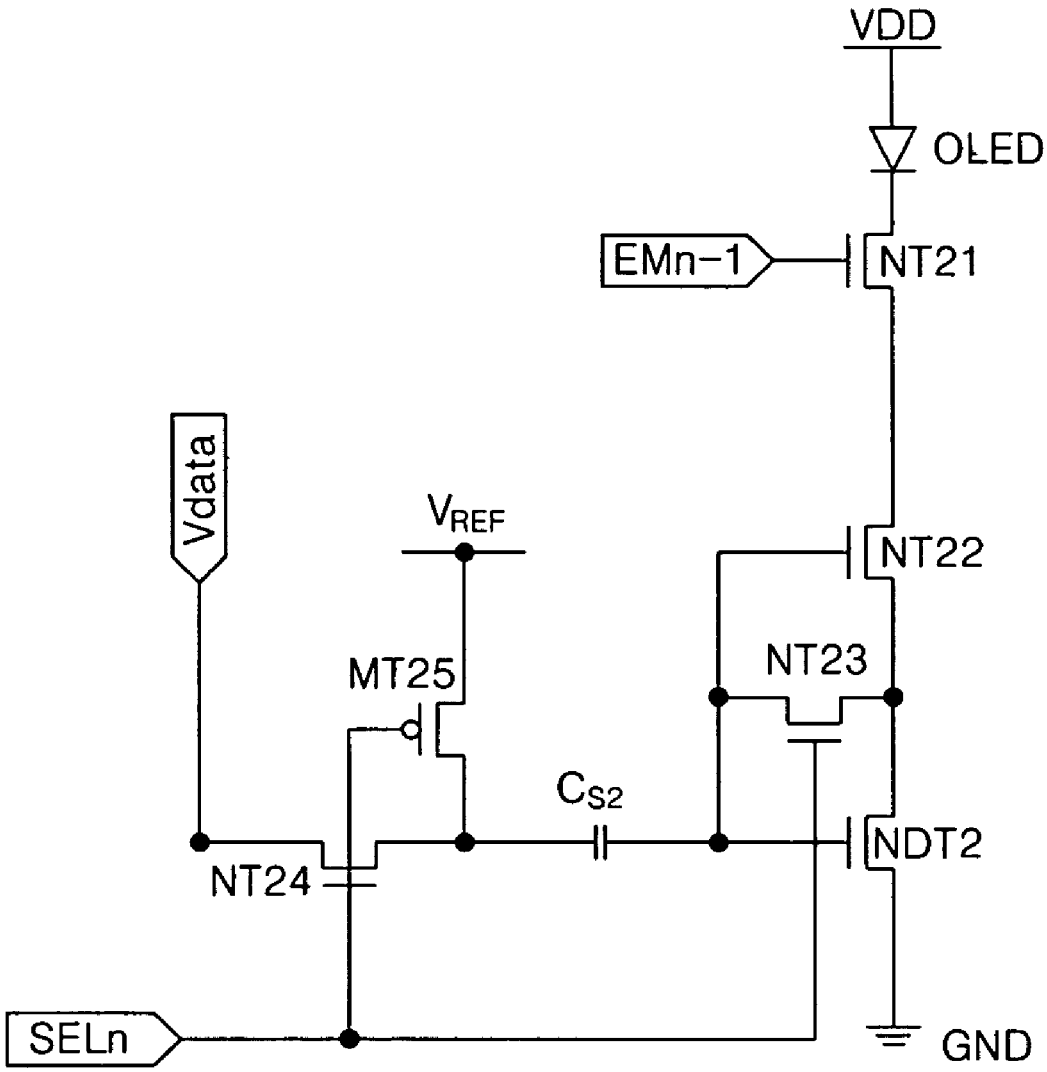
FIG. 14 illustrates an alternate configuration for the cell driving circuit using a different type of switch for the organic electro-luminescence device of FIG. 11.

FIG. 14 illustrates an alternate configuration for the cell driving circuit using a different type of switch for the organic electro-luminescence device of FIG. 11. As shown in FIG. 14, the fifth switch MT25 can be a P-type device. The first to fourth switches NT21 to NT24 can be N-type devices. The driving switch NDT2 is also an N-type device.

Figure 15:
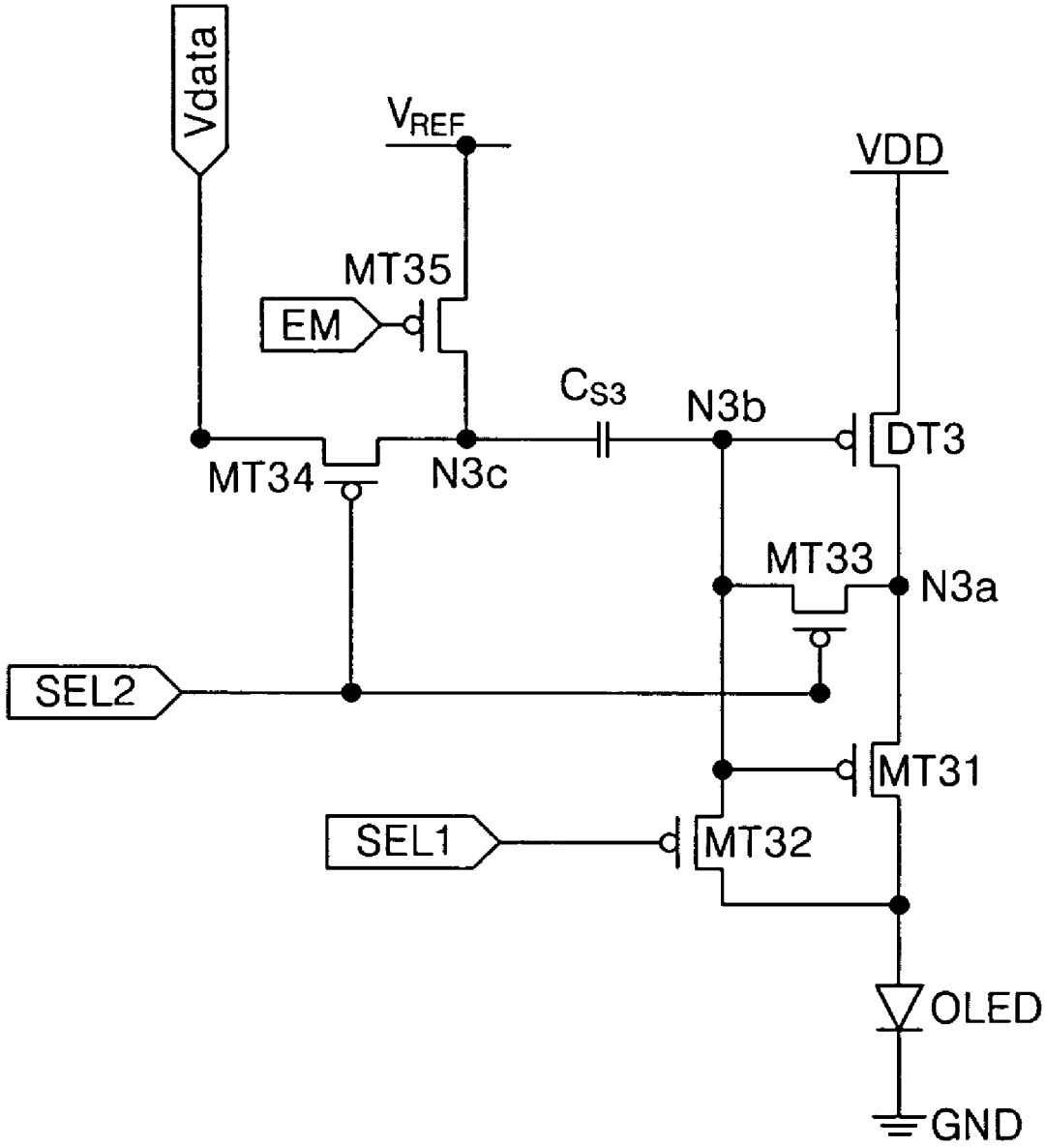
FIG. 15 shows an exemplary cell driving circuit for driving the pixel cells in the organic electro-luminescence device, according to a third embodiment of the present invention.

FIG. 15 shows an exemplary cell driving circuit for driving the pixel cells in the organic electro-luminescence device according to a third embodiment of the present invention. Referring to FIG. 15, an exemplary pixel cell includes a driving switch DT3 connected between a high-level voltage source VDD and a ground GND. An organic light-emitting diode OLED is connected between the driving switch DT3 and the ground GND. A first switch MT31 is connected between a connecting node N3*a* of the driving switch DT3 and the light-emitting diode OLED. A second switch MT32 is connected between the gate and the source of the first switch MT31. A third switch MT33 is connected between the gate and the source of the driving switch DT3. A fourth switch MT34 is connected between a data voltage source Vdata and the gate terminal of the driving switch DT3. A capacitor Cs3 is connected between a connecting node N3*c* at a terminal of the fourth switch MT34 and a connecting node N3*b* at the gate terminal of the driving switch DT3. A fifth switch MT35 has a terminal connected between the fourth switch MT34 and the capacitor Cs3, and another terminal connected to a reference voltage Vref.

The second switch MT32 is supplied with a first selection signal SEL1. The third switch MT33 and the fourth switch MT34 are supplied with a second selection signal SEL2. The fifth switch MT35 is provided with a third selection signal EM.

Herein, the first selection signal SEL1 is a signal that is delayed by one horizontal period with respect to the second selection signal SEL2 supplied from the first selection signal of a pre-stage gate. The third selection signal EM and the second selection signal SEL2 are in opposite phase with respect to each other. The device characteristics of the driving switch DT3 and the first switch MT31 are similarly formed during device fabrication, that is, during a polysilicon crystallization process. Accordingly, the driving switch DT3 and the first switch MT31 are similar in area and length.

Figure 16:
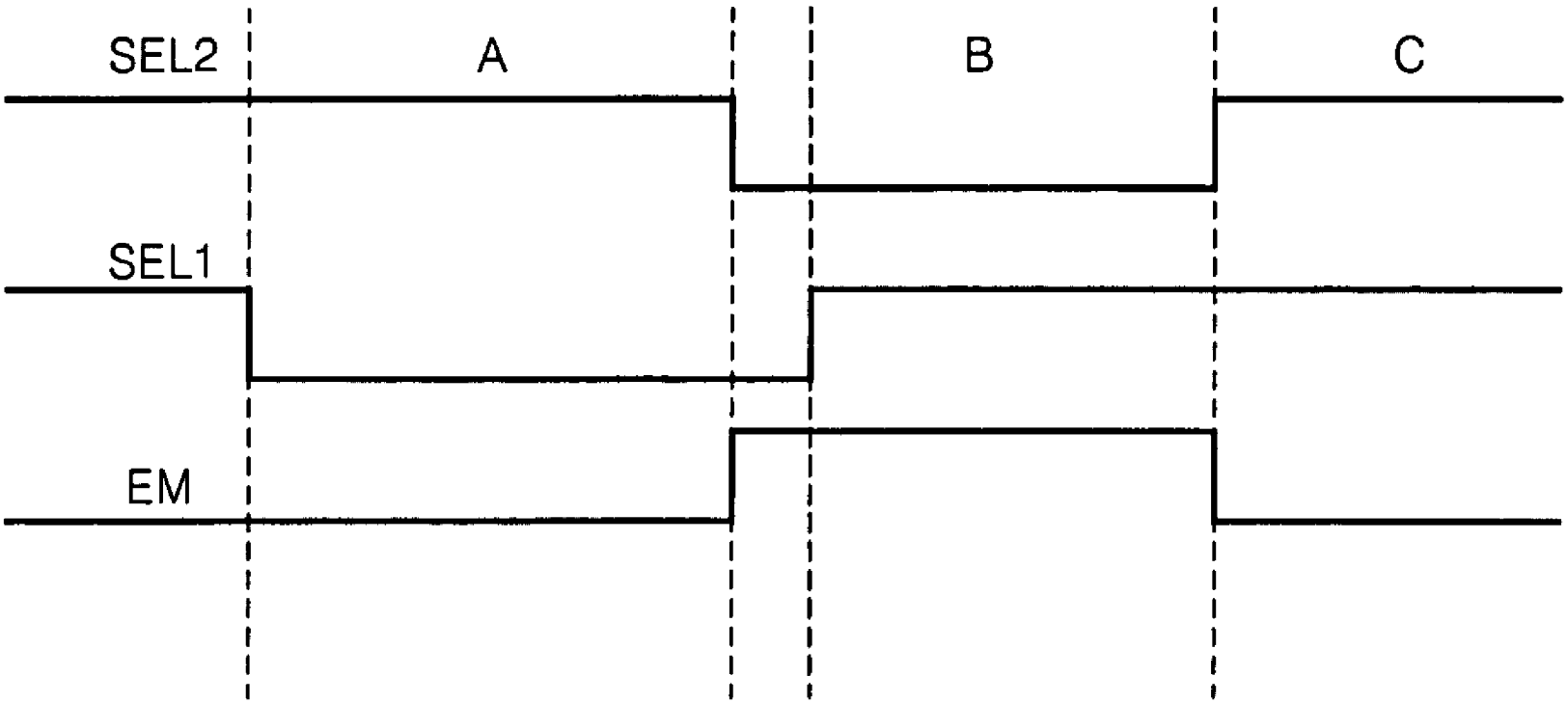
FIG. 16 is a driving waveform diagram for the cell driving circuit shown in FIG. 15.

FIG. 16 is a driving waveform diagram for the cell driving circuit shown in FIG. 15. Referring to FIG. 16, during a first time period A, the first selection signal SEL1 is low, the second selection signal SEL2 is high, and the third selection signal EM is low. The low level first selection signal SEL1, which is a pre-stage gate selection signal, and the low level third selection signal EM turne on the second switch MT32 and the fifth switch MT35. Thus, the driving switch DT3 and the second switch MT32 form a diode connection. Then, the voltage at the node N3*a* is the difference between the high-level voltage VDD and a threshold voltage Vth of the driving switch DT3. The reference voltage Vref is applied to the third node N3*c*.

During the second and third time periods B and C, the cell driving circuit operates similarly to the driving circuit described above in reference to the first embodiment of the present invention. Thus, further explanations of the operation of driving circuit during the second and third time periods will be omitted.

In accordance with the third embodiment of the present invention, the cell driving circuit initializes the first node N3*a* using the selection signal of the pre-stage gate. Here, the voltage at the first node N3*a* is applied to the light-emitting diode OLED during one horizontal period. This may cause loss of contrast because the light-emitting diode OLED is emitting light during the entire horizontal period.

Figure 17:
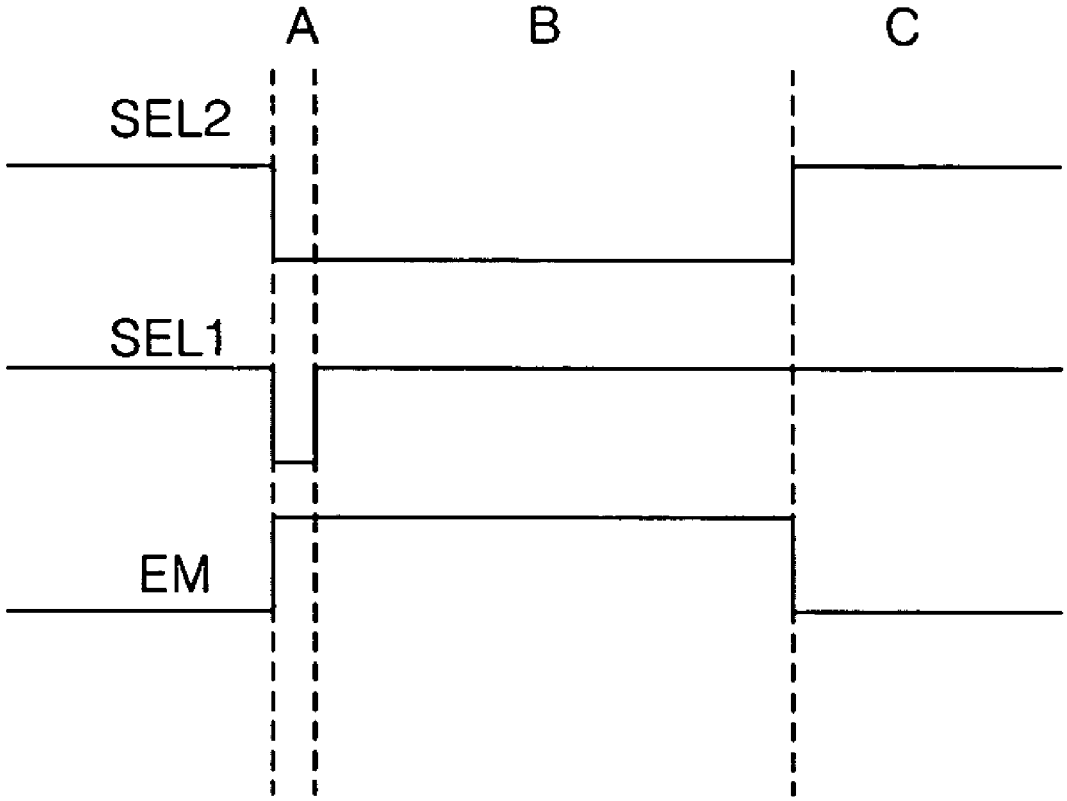
FIG. 17 is an alternate driving waveform diagram for the cell driving circuit shown FIG. 15.

FIG. 17 is an alternate driving waveform diagram for the cell driving circuit shown in FIG. 15. Referring to FIG. 17, the first selection signal SEL1 has a low level during a short time period. Thus, the light-emitting diode only emits light during the short time period. Hence, contrast is improved.

Figure 18:
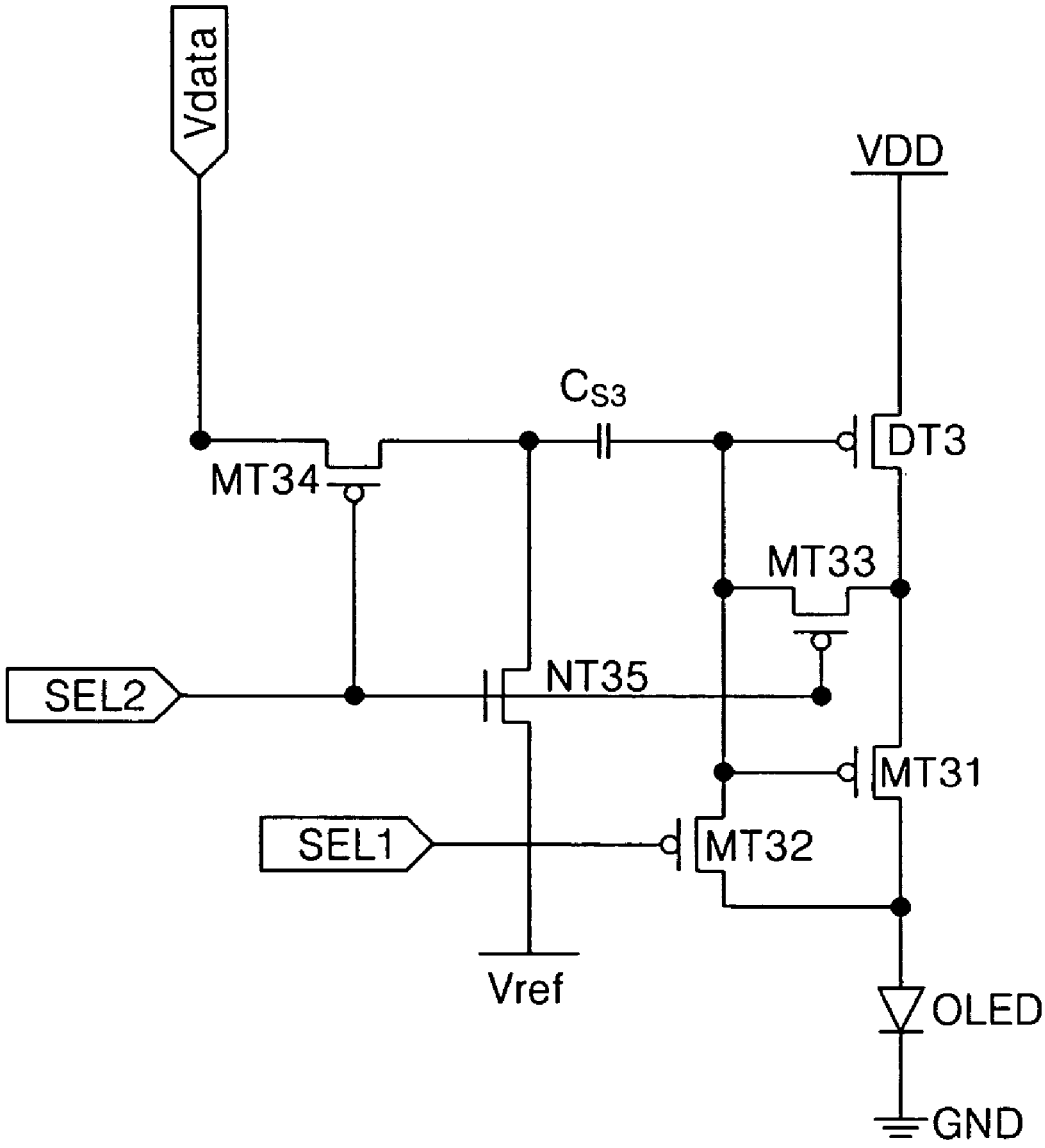
FIG. 18 shows another exemplary cell driving circuit using an N-type device for driving the pixel cells in the organic electro-luminescence device of FIG. 15.

FIG. 18 shows another exemplary cell driving circuit using an N-type device for driving the pixel cells in the organic electro-luminescence device of FIG. 15. As shown in FIG. 18, the fifth switch NT35 can be an N-type device formed by a CMOS process. Here, a third signal selection line can be omitted. Then, the fifth switch NT35 can be driven with the second selection signal SEL2 rather than the third selection signal.

Figure 19:
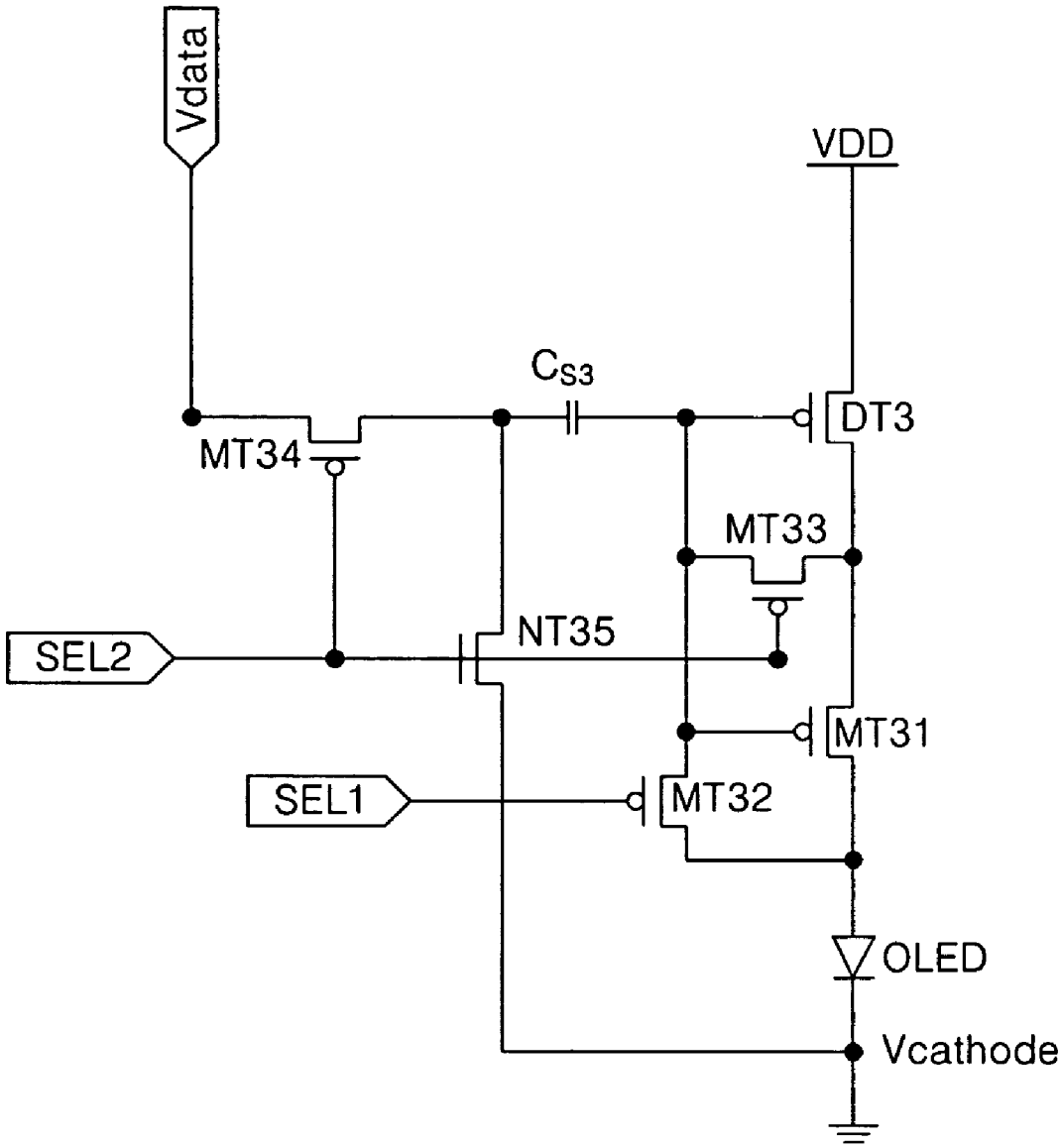
FIG. 19 shows yet another exemplary cell driving circuit using the N-type device of FIG. 18 for driving the pixel cells in the organic electro-luminescence device of FIG. 15.

FIG. 19 shows yet another exemplary cell driving circuit using the N-type device of FIG. 18 for driving the pixel cells in the organic electro-luminescence device of FIG. 15. As shown in FIG. 19, the reference voltage for the fifth switch NT35 is provided by a cathode terminal of the light-emitting diode OLED. Further explanation about the driving method will be omitted because the cell driving circuits shown in FIG. 18 and FIG. 19 are driven similarly to the third embodiment of the present invention described in reference to FIGS. 15, 16 and 17.

The device characteristics of the driving switch DT3 and the first switch MT31 are similarly formed during device fabrication, that is, during a polysilicon crystallization process. Accordingly, the driving switch DT3 and the first switch MT31 are similar in area and length.

Figure 20:
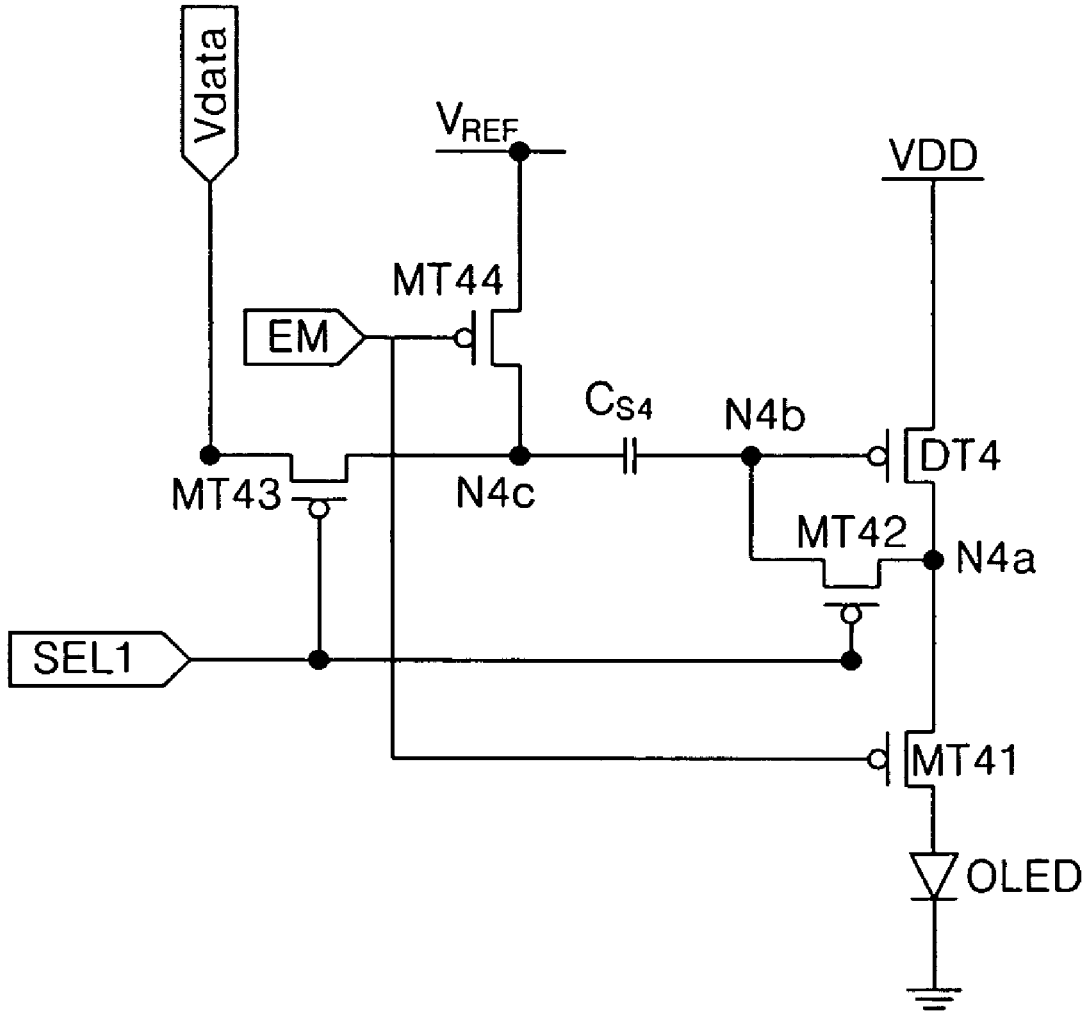
FIG. 20 shows an exemplary cell driving circuit for driving the pixel cells in the organic electro-luminescence device, according to a fourth embodiment of the present invention.

FIG. 20 shows an exemplary cell driving circuit for driving the pixel cells in the organic electro-luminescence device according to a fourth embodiment of the present invention. Referring to FIG. 20, the cell driving circuit includes a light-emitting diode OLED connected between a high-level voltage source VDD and a ground GND. A driving switch DT4 is connected between a high-level voltage source VDD and the light-emitting diode OLED. A first switch MT41 is connected between the light-emitting diode OLED and a connecting node N4*a* at a terminal of the driving switch DT4. A second switch MT42 is connected between the gate and the drain of the driving switch DT4. A third switch MT43 is connected between a data voltage source Vdata for supplying a data signal and a gate terminal of the driving switch DT4. A capacitor Cs4 is connected between a connecting node N4*c* at a terminal of the third switch MT43 and a connecting node N4*b* at the gate terminal of the driving switch DT4. A fourth switch MT44 is connected between the node N4*c*, where the terminal of the third switch MT43 is connected to the capacitor Cs4, and the reference voltage Vref.

Herein, the second switch MT42, the third switch MT43, and the fourth switch MT44 are supplied with a second selection signal EM. The first switch MT41 is supplied with a second selection signal EM. The fourth switch MT44 is an N-type device. The data voltage Vdata is larger than the reference voltage Vref.

Figure 21:
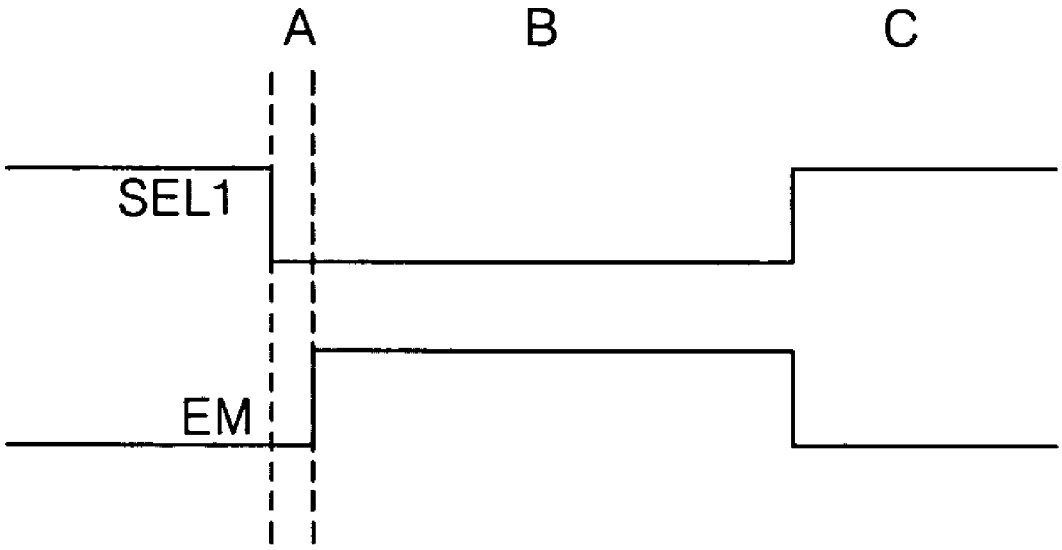
FIG. 21 is a driving waveform diagram for the cell driving circuit shown in FIG. 20.

FIG. 21 is a driving waveform diagram for the cell driving circuit shown in FIG. 20. Referring to FIG. 21, during a first time period A, the first and second selection signals SEL1 and EM are both low. The low level first selection signal SEL1 and the low level second selection signal EM are applied to the first to fourth switches MT41 to MT44, respectively. The first to third switches MT41 to MT43 are turned on, while the fourth switch MT44 is turned off. Thus, the driving switch DT4 operates in a diode connection mode. The turned-on first switch MT41 provides a current path extending from the high-level voltage source VDD to the ground GND. Then, the first node N1*a* is initialized to a voltage which is the difference between the high-level voltage VDD and the threshold voltage Vth of the driving switch DT4. The second node N1*b* also has voltage which is the difference between the high-level voltage VDD and the threshold voltage Vth of the driving switch DT4. The data voltage Vdata is charged into the third node N4*c* through the third switch MT43, which is on.

During the second and third time periods B and C, the cell driving circuit according of FIG. 20 operates similarly to the cell driving circuit described above in reference to the first embodiment of the present invention. Thus, further explanation about the operation of the cell driving circuit during these time periods will be omitted.

Figure 22:
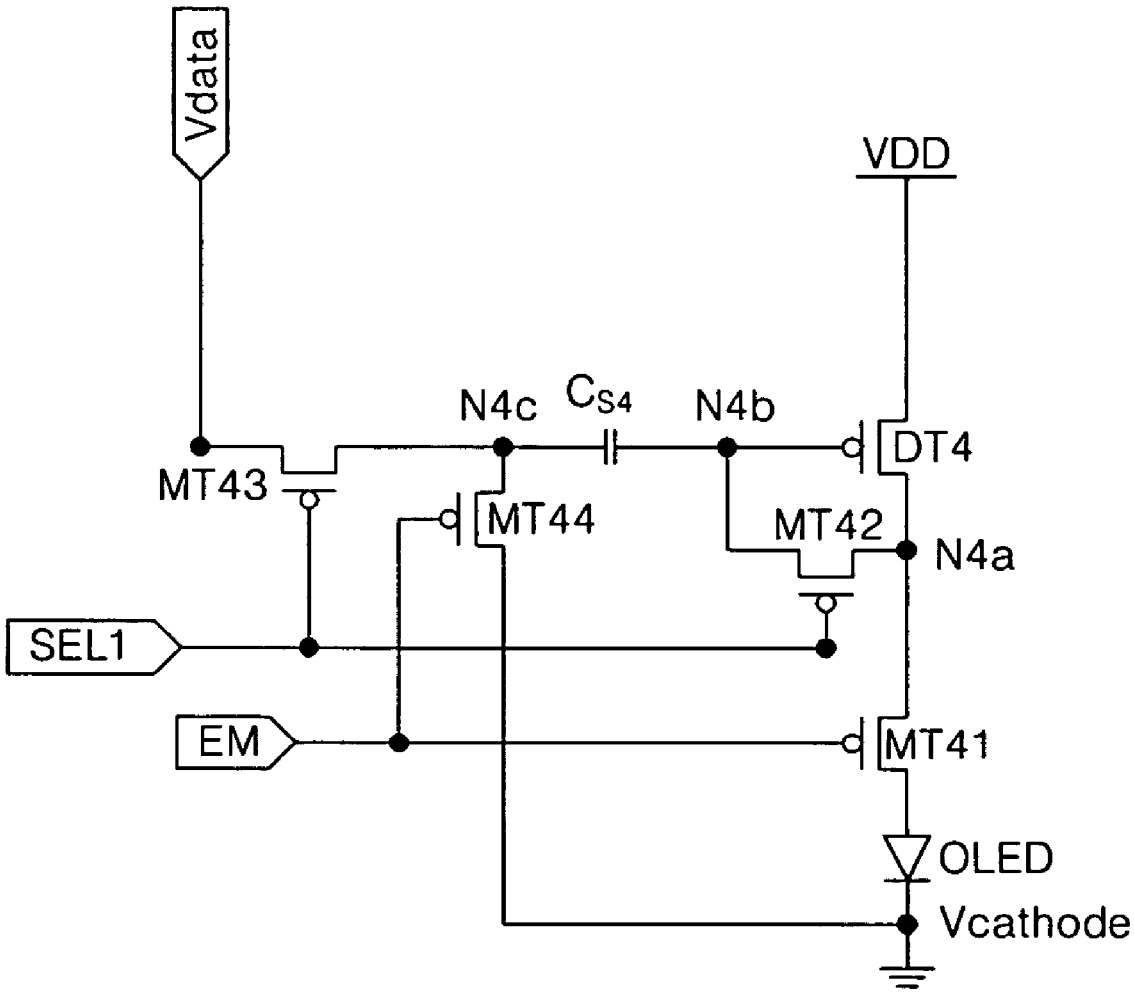
FIG. 22 shows another exemplary cell driving circuit for driving the pixel cells in the organic electro-luminescence device of FIG. 20.

FIG. 22 shows another exemplary cell driving circuit for driving the pixel cells in the organic electro-luminescence device of FIG. 20. Referring to FIG. 22, the reference voltage for the fourth switch MT44 is provided by a cathode voltage of the light-emitting diode OLED. No additional reference voltage source Vref is required.

Figure 23:
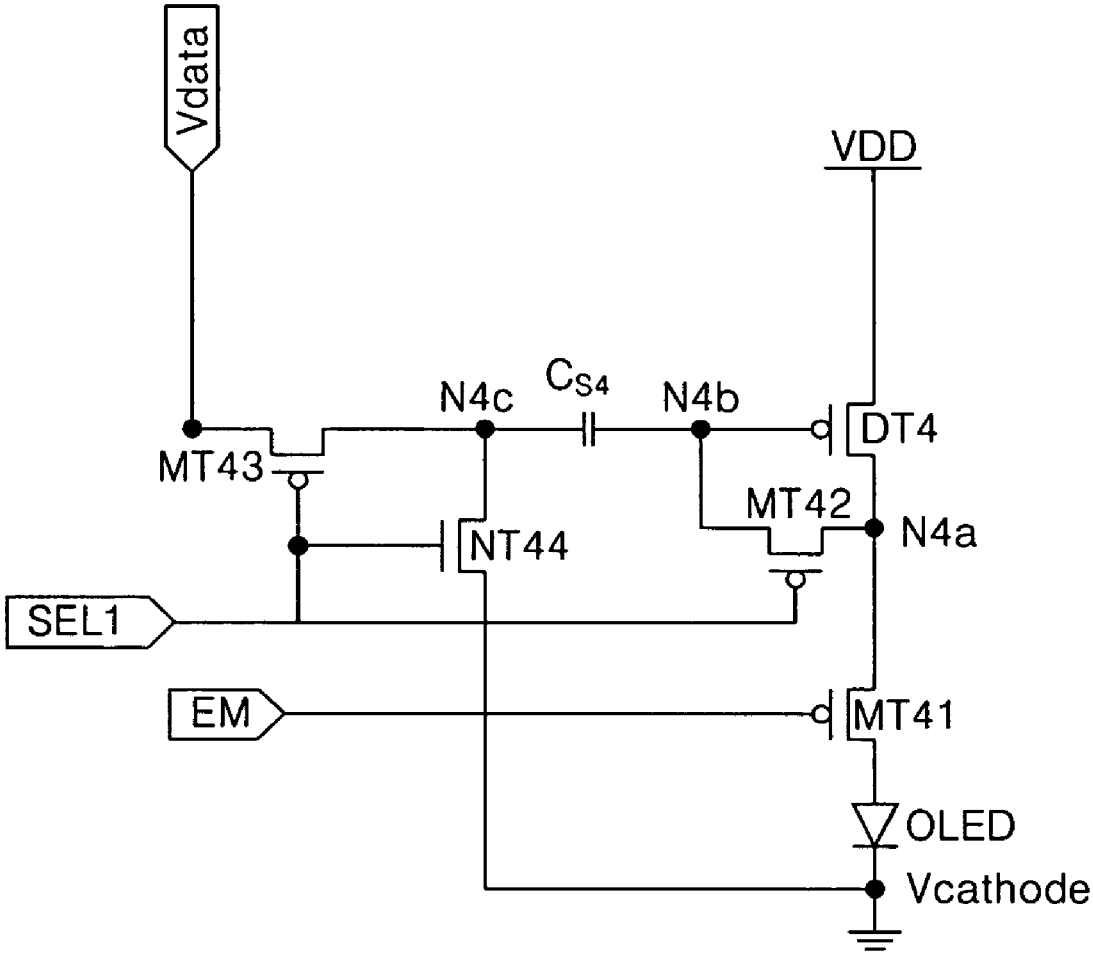
FIG. 23 shows another exemplary cell driving circuit using an N-type device for driving the pixel cells in the organic electro-luminescence device of FIG. 20.

FIG. 23 shows another exemplary cell driving circuit using an N-type device for driving the pixel cells in the organic electro-luminescence device of FIG. 20. Referring to FIG. 23, the fourth switch NT44 can be a P-type device. The first node N4*a* is initialized by applying the second selection signal EM at the gate of the first switch MT41. Further explanation about the driving method will be omitted because the cell driving circuits shown in FIG. 22 and FIG. 23 are driven similarly to the fourth embodiment of the present invention described in reference to FIGS. 20 and 21.

Figure 24:
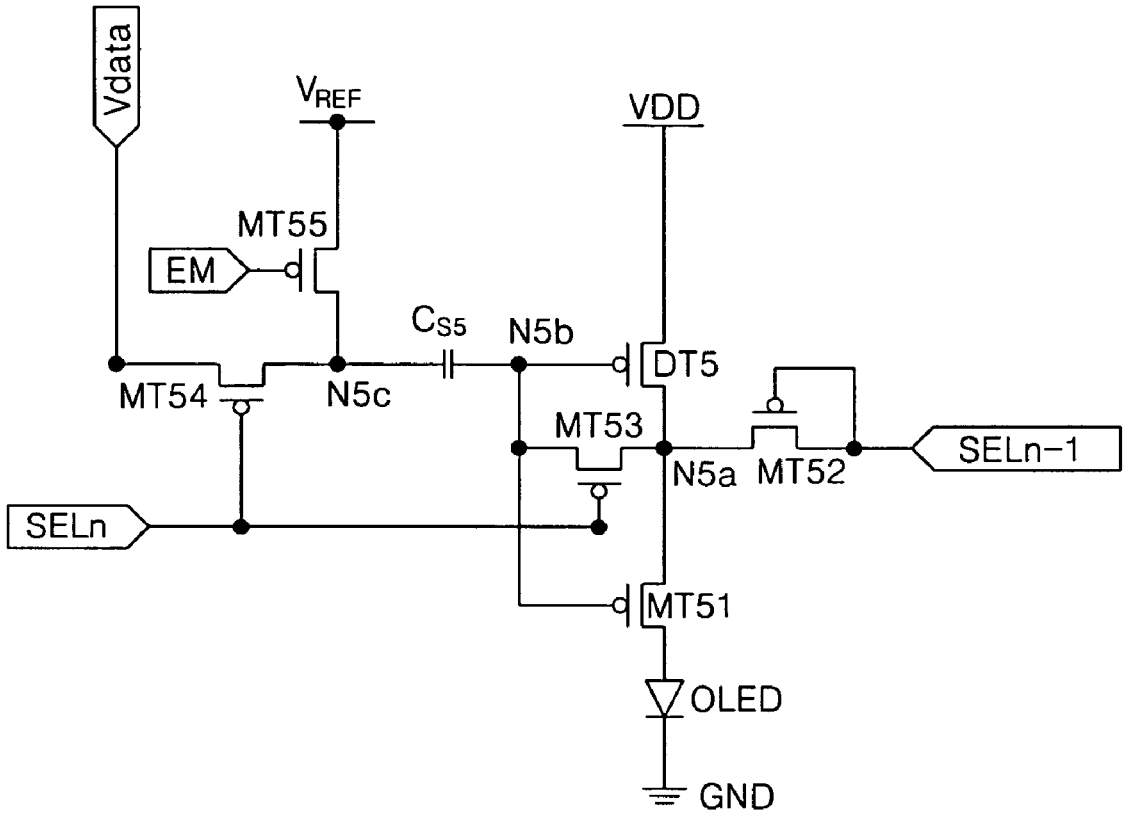
FIG. 24 shows an exemplary cell driving circuit for driving the pixel cells in the organic electro-luminescence device, according to a fifth embodiment of the present invention.

FIG. 24 shows an exemplary cell driving circuit for driving the pixel cells in the organic electro-luminescence device according to a fifth embodiment of the present invention. Referring to FIG. 24, the cell driving circuit has a structure similar to the cell driving circuit described in reference to the third embodiment of the present invention. Here, the second switch MT32 is omitted between the gate terminal and the drain terminal of the first switch MT31. A second switch MT52 is provided. The second switch MT52 is in a diode connection mode and is connected to a first node N5*a*. The second switch MT52 is supplied with a third selection signal SELn−1. The third selection signal SELn−1 is delayed with respect to the first selection signal SELn. Herein, further explanation unrelated to the second switch MT52 will be omitted.

Figure 25:
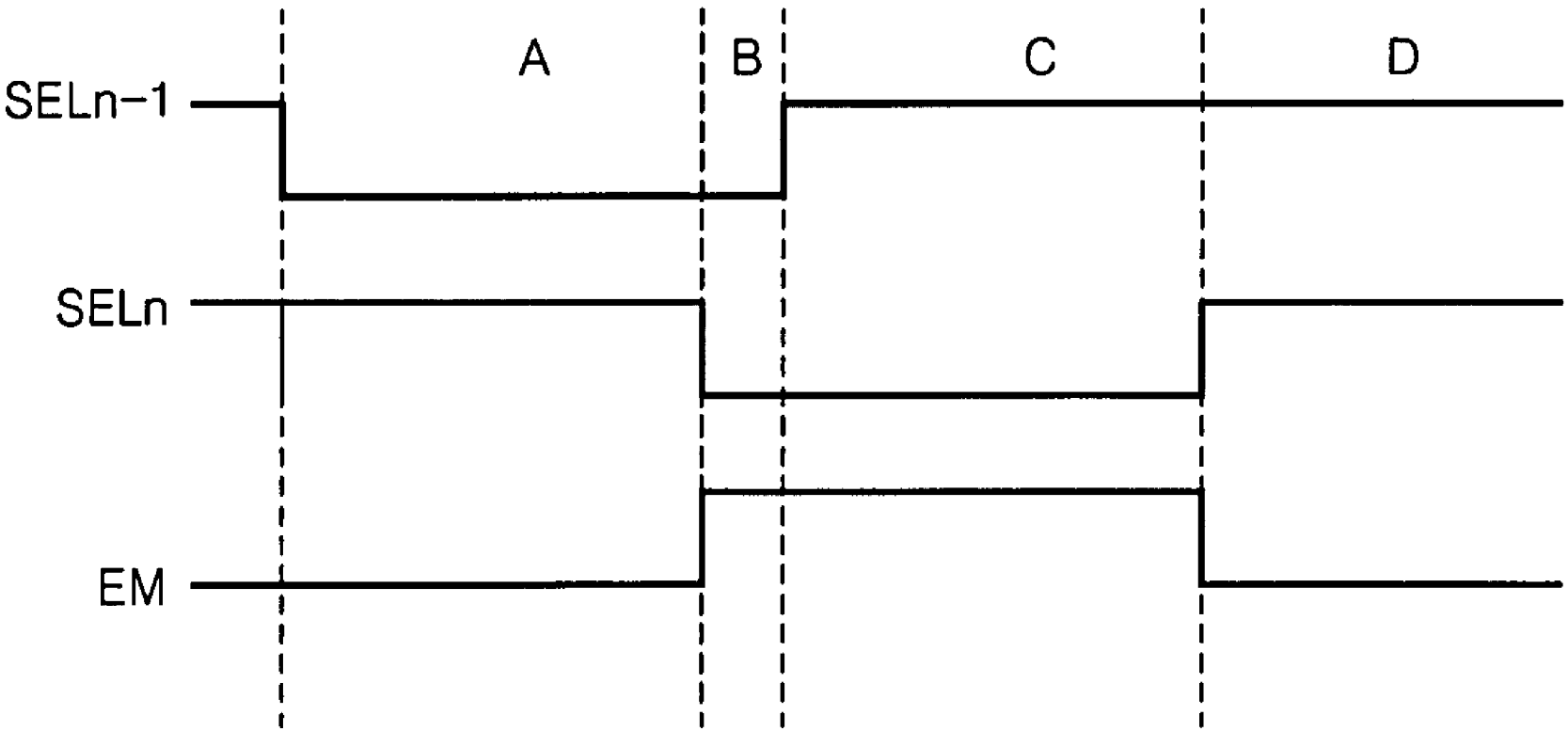
FIG. 25 is a driving waveform diagram for the cell driving circuit shown in FIG. 24.

FIG. 25 is a driving waveform diagram for the cell driving circuit shown in FIG. 24. Referring to FIG. 25, during a first time period A, the first selection signal SELn is high, the second selection signal EM is low, and the third selection selection signal SELn−1 is low. The second switch MT52 is turned on by the low level third selection signal SELn−1.

Thus, the first node N5*a* is initialized to a threshold voltage of the second switch MT52. Then, the fifth switch MT55 is turned on by the low level second selection signal EM, thereby pulling the third node N5*c* to the level of the reference voltage Vref.

During the second, third and fourth time periods B, C, and D, the first to third nodes N5*a* to N5*c* are driven in a manner similar to the above described embodiments of the present invention.

Figure 26:
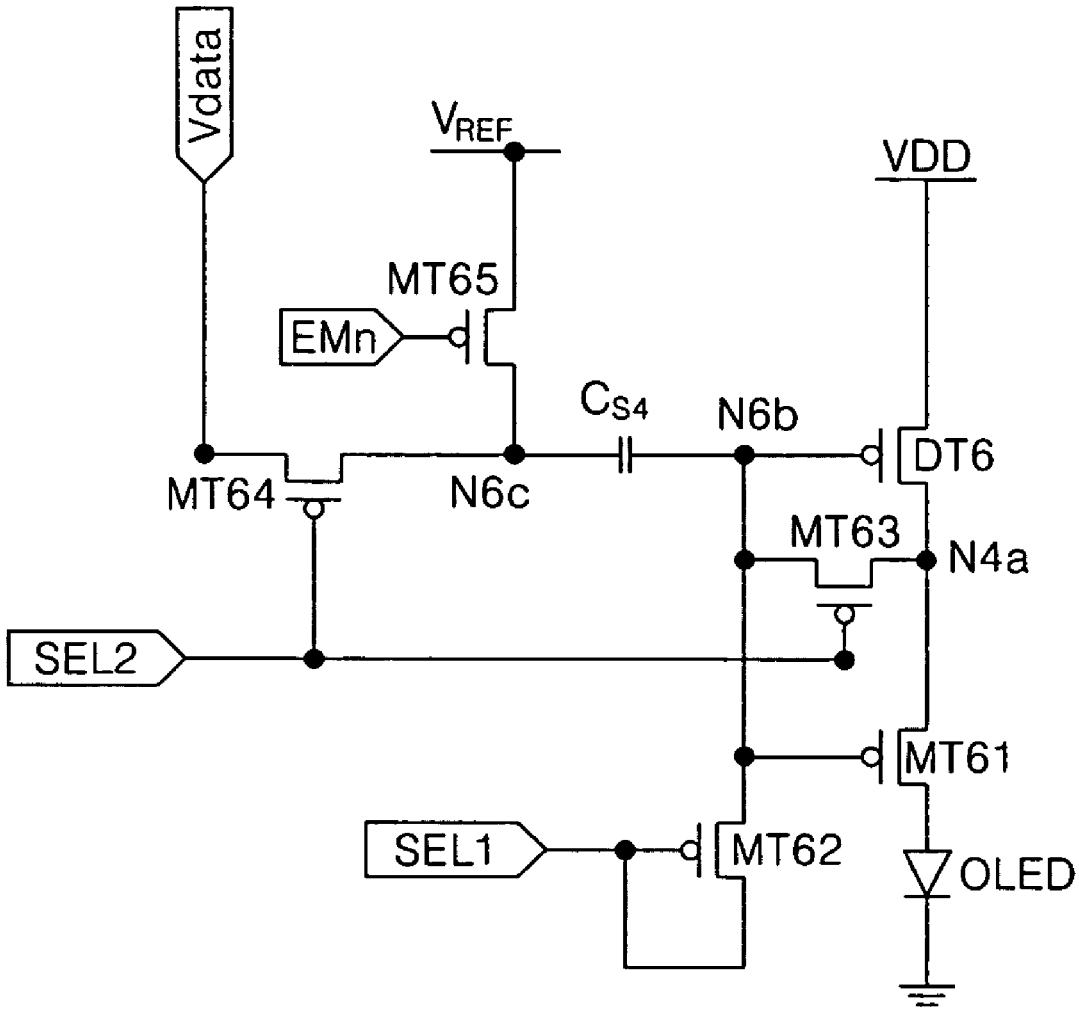
FIG. 26 shows an exemplary cell driving circuit for driving the pixel cells in the organic electro-luminescence device, according to a sixth embodiment of the present invention.

FIG. 26 shows an exemplary cell driving circuit for driving the pixel cells in the organic electro-luminescence device according to a sixth embodiment of the present invention. Referring to FIG. 26, the cell driving circuit has a structure similar to that described in reference to the fifth embodiment of the present invention. Here, the second switch MT52 is excluded from the first node. A second switch MT62, which is in a diode connection mode, is connected to the gate terminal of the first switch MT61. The second switch MT62 is supplied with a first selection signal SEL1. Herein, further explanation unrelated to the second switch MT62 will be omitted.

Figure 27:
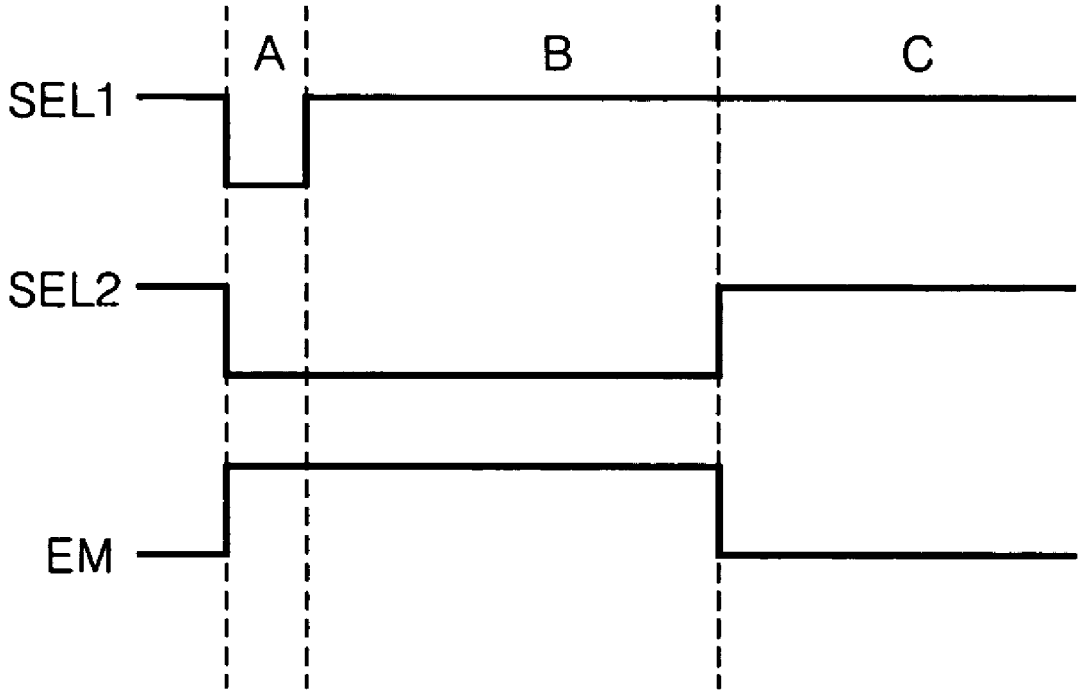
FIG. 27 is a driving waveform diagram for the cell driving circuit shown in FIG. 26.

FIG. 27 is a driving waveform diagram for the cell driving circuit shown in FIG. 26. Referring to FIG. 27, during a first time period A, the first selection signal SEL1 is low. The second switch MT62 is turned on by the low level first selection signal SEL1. Thus, a threshold voltage of the second switch MT62 is applied to the gate terminal of the driving switch DT6, which is thus initialized.

During the second and third time periods, B and C, the driving circuit is driven in a manner similar to the above described embodiments of the present invention. Thus, further explanation in this regard will be omitted.

In accordance with the above-described embodiments of the present invention, the cell driving circuit drives the light-emitting diode in a manner independent of the characteristics of the driving TFT device and the power consumed by the wires connecting the display device to the high-level voltage source. A variation in the threshold voltage of the driving switch or the high-level voltage source does not cause a change in the driving current through the light-emitting diode. Thus, a driving current through the light-emitting diode can be made independent of the characteristics of the driving TFT device and variations in the high-level voltage source. Accordingly, embodiments of the present invention do not suffer from a stripe phenomenon caused by variations in threshold voltage, which depends on a device characteristic of the driving switch, and a current/resistance drop phenomenon of the high-level voltage source, which may be generated when driving a large screen display.

It will be apparent to those skilled in the art that various modifications and variations can be made in the liquid crystal display device of the present invention, and the method for fabricating the same, without departing from the spirit or scope of the invention. Thus, it is intended that the present invention cover the modifications and variations of this invention provided they come within the scope of the appended claims and their equivalents.

What is claimed is:

1. A driving apparatus for an organic light-emitting diode, comprising:

an organic light-emitting diode;

a driving switch that drives the organic light-emitting diode in response to a control voltage applied to a gate terminal of the driving switch;

a high-level voltage source that supplies a high-level voltage to the driving switch;

a data driving circuit that supplies a data voltage to a data line of the driving apparatus;

a reference voltage source that supplies a reference voltage to the driving apparatus; and a capacitor has a first electrode connected to the gate terminal of the driving switch via a first node, and a second electrode connected to a second node;

a first switch between the high-level voltage source and a drain of the driving switch and controlled by a first selection signal provided from a pre-stage scan line;

a second switch between a source of the driving switch and the organic light-emitting diode;

a third switch between the gate and the source of the driving switch and controlled by a second selection signal provided from a selection signal line;

a fourth switch between the data line and the second node of the capacitor and controlled by the second selection signal; and a fifth switch between the second node and the reference voltage source and controlled by a third selection signal provided from a present-stage scan line, wherein the second selection signal and the third selection signal are in opposite phase with respect to each other, and the first selection signal is in opposite phase and delayed by one horizontal period with respect to the second selection signal.

2. The driving apparatus according to claim 1, wherein each of the first to fifth switches includes one of a P-type switch and an N-type switch.

* * * * *